US012628869B2

(12) United States Patent
Batley et al.

(10) Patent No.: US 12,628,869 B2
(45) Date of Patent: May 19, 2026

(54) INSERT FOR USE WITH VAPORIZER DEVICE

(71) Applicant: JUUL Labs, Inc., San Francisco, CA (US)

(72) Inventors: Oliver J. Batley, Cambridge (GB); Ian Garcia-Doty, Oakland, CA (US); Xenofon Kalogeropoulos, Cambridge (GB); Joshua A. Kurzman, San Francisco, CA (US); Alexander R Mauchle, Milton Keynes (GB); Andrew D. Newbold, Ixworth (GB); Simon J. Smith, Hertford (GB); Paul R. Vieira, Oakland, CA (US)

(73) Assignee: JUUL Labs, Inc., Washington, DC (US)

( * ) Notice: Subject to any disclaimer, the term of this patent is extended or adjusted under 35 U.S.C. 154(b) by 434 days.

(21) Appl. No.: 17/520,390

(22) Filed: Nov. 5, 2021

(65) Prior Publication Data

US 2022/0053828 A1 Feb. 24, 2022

Related U.S. Application Data

(63) Continuation of application No. PCT/US2020/031628, filed on May 6, 2020.

(60) Provisional application No. 62/876,575, filed on Jul. 19, 2019, provisional application No. 62/863,227, filed on Jun. 18, 2019, provisional application No. 62/844,001, filed on May 6, 2019.

(30) Foreign Application Priority Data

Jul. 12, 2019 (GR) ..... 20190100302

(51) Int. Cl.

| | |
|---|---|
| ***A24F 40/42*** | (2020.01) |
| ***A24F 40/10*** | (2020.01) |
| ***A24F 40/20*** | (2020.01) |
| ***A24F 40/46*** | (2020.01) |

(52) U.S. Cl.

CPC ..... *A24F 40/42* (2020.01); *A24F 40/10* (2020.01); *A24F 40/20* (2020.01); *A24F 40/46* (2020.01)

(58) Field of Classification Search

CPC ..... A24F 40/10; A24F 40/20; A24F 40/42; A24F 40/46

See application file for complete search history.

(56) References Cited

U.S. PATENT DOCUMENTS

| | | | | |
|---|---|---|---|---|
| 3,373,915 | A | 3/1968 | Anderson et al. | |
| 3,559,655 | A * | 2/1971 | Briskin | A24B 15/165 162/158 |
| 3,584,631 | A * | 6/1971 | Halter | A24B 15/12 131/355 |
| 3,828,799 | A | 8/1974 | Beam | |
| 4,079,742 | A | 3/1978 | Rainer et al. | |
| 4,708,151 | A | 11/1987 | Shelar | |
| 5,042,509 | A | 8/1991 | Banerjee et al. | |
| 5,065,776 | A | 11/1991 | Lawson et al. | |
| 5,249,586 | A | 10/1993 | Morgan et al. | |
| 5,479,948 | A | 1/1996 | Counts et al. | |
| 7,726,320 | B2 | 6/2010 | Robinson et al. | |
| 8,490,629 | B1 | 7/2013 | Shenassa et al. | |
| 8,671,952 | B2 | 3/2014 | Winterson et al. | |
| 8,869,792 | B1 | 10/2014 | Lee | |
| 8,991,402 | B2 | 3/2015 | Bowen et al. | |
| 9,408,416 | B2 | 8/2016 | Monsees et al. | |
| 9,603,389 | B2 | 3/2017 | Chen | |
| 9,943,114 | B2 | 4/2018 | Batista | |
| 10,512,285 | B2 | 12/2019 | Kuczaj | |
| 10,729,179 | B2 | 8/2020 | Atkins et al. | |
| 11,129,414 | B2 | 9/2021 | Atkins et al. | |
| 11,147,128 | B2 | 10/2021 | Qiu | |
| 11,197,497 | B2 | 12/2021 | Lee et al. | |
| 11,464,082 | B2 | 10/2022 | Jobanputra et al. | |
| 11,700,874 | B2 | 7/2023 | Alizon et al. | |
| 12,010,782 | B2 | 6/2024 | Horrod et al. | |
| 12,156,538 | B2 | 12/2024 | Leah et al. | |

(Continued)

FOREIGN PATENT DOCUMENTS

| | | | |
|---|---|---|---|
| CA | 3010559 | A1 | 7/2017 |
| CN | 102753047 | A | 10/2012 |

(Continued)

OTHER PUBLICATIONS

English Translation of KR 20160112769A (Year: 2016).*

(Continued)

*Primary Examiner* — Michael H. Wilson
*Assistant Examiner* — Adam Z Baratz
(74) *Attorney, Agent, or Firm* — Mintz, Levin, Cohn, Ferris, Glovsky and Popeo, P.C.

(57) ABSTRACT

Various embodiments of a system for generating an inhalable aerosol are described. The system includes a insert configured to be inserted into a compartment of a vaporizer device. In some embodiments, the insert includes a jacket defining an inner chamber configured to contain a vaporizable material and a heating element configured to heat the vaporizable material, thereby generating the inhalable aerosol. In some embodiments, the insert may include a filter at least partly saturated with a second vaporizable material and configured to generate a vapor when heated by the heating element, thereby forming a mixture of inhalable aerosol. Related systems, methods, and articles of manufacture are also described.

18 Claims, 19 Drawing Sheets

(56) References Cited

U.S. PATENT DOCUMENTS

2004/0055613 A1 3/2004 Horian
2005/0268911 A1 12/2005 Cross et al.
2006/0032501 A1 2/2006 Hale et al.
2007/0221234 A1 9/2007 Beckstead
2007/0283972 A1 12/2007 Monsees et al.
2008/0092912 A1* 4/2008 Robinson ..... A24D 1/002 131/200
2009/0126746 A1 5/2009 Strickland et al.
2009/0151717 A1 6/2009 Bowen et al.
2009/0260642 A1 10/2009 Monsees et al.
2010/0024834 A1 2/2010 Oglesby et al.
2011/0041861 A1 2/2011 Sebastian et al.
2011/0226236 A1 9/2011 Buchberger
2011/0290267 A1 12/2011 Yamada et al.
2013/0042865 A1 2/2013 Monsees et al.
2014/0301721 A1* 10/2014 Ruscio ..... A24F 40/46 392/386
2014/0338683 A1 11/2014 Liu
2014/0366898 A1* 12/2014 Monsees ..... A24F 40/30 131/329
2015/0272218 A1* 10/2015 Chen ..... A61M 15/06 131/329
2015/0335070 A1 11/2015 Sears et al.
2016/0073692 A1 3/2016 Alarcon et al.
2016/0120222 A1* 5/2016 Bagai ..... A24F 40/42 206/242
2016/0120225 A1* 5/2016 Mishra ..... A24F 40/42 392/386
2016/0120227 A1 5/2016 Levitz et al.
2016/0295922 A1 10/2016 John et al.
2016/0309782 A1* 10/2016 Malgat ..... A24F 40/465
2016/0309789 A1 10/2016 Thomas, Jr.
2016/0338412 A1 11/2016 Monsees et al.
2017/0035116 A1* 2/2017 Batista ..... B65D 47/36
2017/0055575 A1 3/2017 Wilke et al.
2017/0055580 A1 3/2017 Blandino et al.
2017/0071250 A1 3/2017 Mironov et al.
2017/0143041 A1 5/2017 Batista et al.
2017/0156403 A1 6/2017 Gill et al.
2017/0164657 A1 6/2017 Batista
2017/0203057 A1 7/2017 Buchberger
2017/0333650 A1 11/2017 Buchberger et al.
2018/0027877 A1 2/2018 Tucker et al.
2018/0027883 A1 2/2018 Zuber et al.
2018/0084823 A1 3/2018 Fuisz et al.
2018/0110263 A1 4/2018 Borkovec et al.
2018/0132534 A1 5/2018 Reevell
2018/0177233 A1 6/2018 Tucker et al.
2018/0228216 A1 8/2018 Saygili
2018/0295881 A1 10/2018 Mironov et al.
2018/0325179 A1 11/2018 Li et al.
2018/0343917 A1 12/2018 Sutton et al.
2019/0001077 A1 1/2019 Xu et al.
2019/0037921 A1 2/2019 Kennedy et al.
2019/0098930 A1* 4/2019 Fallon ..... A61M 11/042
2019/0124982 A1 5/2019 Atkins et al.
2019/0166913 A1 6/2019 Trzecieski
2019/0191769 A1 6/2019 Qiu
2019/0200674 A1 7/2019 Tucker et al.
2019/0200677 A1* 7/2019 Chong ..... A24D 3/17
2019/0208827 A1 7/2019 Mironov et al.
2020/0093181 A1 3/2020 Hubbard et al.
2020/0107585 A1 4/2020 Atkins et al.
2020/0113245 A1 4/2020 Rosser et al.
2020/0120993 A1 4/2020 Atkins et al.
2020/0196676 A1 6/2020 Zhu
2020/0324066 A1 10/2020 Potter
2021/0030073 A1 2/2021 Yang et al.
2021/0186113 A1 6/2021 Lee
2021/0244103 A1 8/2021 Courbat et al.
2021/0321672 A1 10/2021 Wilke et al.
2021/0386120 A1* 12/2021 Gill ..... H05B 6/10
2022/0030953 A1 2/2022 Woods et al.
2022/0046997 A1 2/2022 Atkins et al.
2022/0095685 A1 3/2022 Atkins et al.
2022/0104550 A1 4/2022 Mao et al.
2022/0151285 A1 5/2022 Garcia-Doty
2022/0160040 A1 5/2022 Zhang et al.
2022/0183374 A1 6/2022 Thorsen
2022/0240586 A1 8/2022 Batista et al.
2022/0295894 A1 9/2022 Batista et al.
2022/0354182 A1 11/2022 Courbat et al.
2023/0055093 A1 2/2023 Ki et al.
2023/0309615 A1 10/2023 Mauchle et al.

FOREIGN PATENT DOCUMENTS

CN 103783674 A 5/2014
CN 104095291 A 10/2014
CN 105764367 A 7/2016
CN 106307622 A 1/2017
CN 106572705 A 4/2017
CN 106659247 A 5/2017
CN 106659250 A 5/2017
CN 106858726 A 6/2017
CN 107772540 A 3/2018
CN 111432670 A 7/2020
CN 113163855 A 7/2021
EP 2394520 A1 12/2011
EP 3420829 A1 1/2019
EP 3664631 A2 6/2020
EP 3795009 A1 3/2021
EP 3829366 A1 6/2021
GB 2527597 A 12/2015
GB 2547699 A 8/2017
GB 2568411 B 8/2019
JP S5138499 A 3/1976
JP 2001-507576 A 6/2001
JP 2010506594 A 3/2010
JP 2010517568 A 5/2010
JP 2010178730 A 8/2010
JP 2013516159 A 5/2013
JP 2015-509709 A 4/2015
JP 2016538847 A 12/2016
JP 2016538850 A 12/2016
JP 2017018146 A 1/2017
JP 2017520263 A 7/2017
JP 2017-529896 A 10/2017
JP 2017529848 A 10/2017
JP 2017533732 A 11/2017
JP 2020536536 A 12/2020
KR 20-20120008751 U 12/2012
KR 20160112769 A * 9/2016
KR 10-2021-0155091 A 12/2021
RU 2602053 C2 11/2016
RU 2604313 C2 12/2016
RU 2629878 C1 9/2017
RU 2655239 C2 5/2018
WO WO-2006120570 A2 11/2006
WO WO-2011079932 A1 7/2011
WO WO-2013060743 A2 5/2013
WO WO-2015082651 A1 6/2015
WO WO-2015155289 A1 10/2015
WO WO-2015177045 A1 11/2015
WO WO-2015179388 A1 11/2015
WO WO-2016005533 A1 1/2016
WO WO-2016062777 A1 4/2016
WO WO-2016079589 A1 5/2016
WO WO-2016162446 A1 10/2016
WO WO-2017072148 A1 5/2017
WO WO-2017122196 A1 7/2017
WO WO-2017129617 A1 8/2017
WO WO-2017185051 A1 * 10/2017 ..... A61M 15/0003
WO WO-2017207418 A1 12/2017
WO WO-2017207419 A1 12/2017
WO WO-2017207582 A1 12/2017
WO WO-2018019578 A1 2/2018
WO WO-2018041065 A1 3/2018
WO WO-2018041924 A1 3/2018
WO WO-2018122389 A1 7/2018
WO WO-2018122978 A1 7/2018
WO WO-2018206615 A2 11/2018
WO WO-2019057942 A1 3/2019

(56) References Cited

FOREIGN PATENT DOCUMENTS

| | | | |
|---|---|---|---|
| WO | WO-2019073237 | A1 | 4/2019 |
| WO | WO-2019088562 | A2 | 5/2019 |
| WO | WO-2019122015 | A1 | 6/2019 |
| WO | WO-2019129693 | A1 | 7/2019 |
| WO | WO-2020028591 | A1 | 2/2020 |
| WO | WO-2020157814 | A1 | 8/2020 |
| WO | WO-2020239599 | A1 | 12/2020 |

OTHER PUBLICATIONS

Guo, et al. (Mar. 31, 2016) "Heat Transfer Performance of Atomizer of Electronic Cigar", Popular Science and Technology, 18(3):52-54.
(2015) "Property Tables and Charts (SI Units)", Wright State University, p. 865-892.

* cited by examiner

INSERT FOR USE WITH VAPORIZER DEVICE

CROSS-REFERENCE TO RELATED APPLICATION

This application is a bypass continuation and claims priority to PCT/US2020/031628, filed on May 6, 2020 and entitled "INSERT FOR USE WITH VAPORIZER DEVICE" which claims priority under 35 U.S.C. § 119(e) to U.S. Provisional application Ser. No. 62/844,001, filed on May 6, 2019 and entitled "TOBACCO INSERT"; U.S. Provisional application Ser. No. 62/863,227, filed on Jun. 18, 2019 and entitled "TOBACCO INSERT"; and U.S. Provisional application Ser. No. 62/876,575, filed on Jul. 19, 2019 and entitled "TOBACCO INSERT," and claims priority under 35 U.S.C. § 119(a) to Greece Non-Provisional application No. 20190100302, filed Jul. 12, 2019 and entitled "TOBACCO INSERT," the disclosures of which are incorporated by reference herein in their entirety.

TECHNICAL FIELD

The subject matter described herein relates to various embodiments of a vaporizer device and various embodiments of a vaporizable material insert for use with the vaporizer device.

BACKGROUND

Vaporizer devices, which can also be referred to as vaporizers, electronic vaporizer devices, or e-vaporizer devices, can be used for delivery of an aerosol (for example, a vapor-phase and/or condensed-phase material suspended in a stationary or moving mass of air or some other gas carrier) containing one or more active ingredients by inhalation of the aerosol by a user of the vaporizing device. For example, electronic nicotine delivery systems (ENDS) include a class of vaporizer devices that are battery powered and that can be used to simulate the experience of smoking. Vaporizers are gaining increasing popularity both for prescriptive medical use, in delivering medicaments, and for consumption of tobacco, nicotine, and other plant-based materials. Vaporizer devices can be portable, self-contained, and/or convenient for use.

In use of a vaporizer device, the user inhales an aerosol, colloquially referred to as "vapor," which can be generated by a heating element that vaporizes a vaporizable material, for example, by causing the vaporizable material to transition at least partially to a gas phase. The vaporizable material may be a liquid, a solution, a solid, a paste, a wax, and/or any other form compatible for use with a specific vaporizer device. Moreover, the vaporizable material used with a vaporizer can be provided within a vaporizer cartridge, which may be a separable part of the vaporizer device that contains the vaporizable material and having an outlet (e.g., a mouthpiece) for delivering the aerosol generated by the vaporization of the vaporizable material to a user.

To receive the inhalable aerosol generated by a vaporizer device, a user may, in certain examples, activate the vaporizer device by taking a puff, by pressing a button, and/or by some other approach. A puff as used herein can refer to inhalation by the user in a manner that causes a volume of air to be drawn into the vaporizer device such that the inhalable aerosol is generated when the vaporized vaporizable material is combined with the volume of air.

An approach by which a vaporizer device generates an inhalable aerosol from a vaporizable material involves heating the vaporizable material in a vaporization chamber (e.g., a heater chamber) to cause the vaporizable material to be converted to the gas (or vapor) phase. A vaporization chamber can refer to an area or volume in the vaporizer device within which a heat source (for example, a conductive, convective, and/or radiative heat source) causes heating of a vaporizable material to produce a mixture of air and vaporized material to form a vapor for inhalation of the vaporizable material by a user of the vaporization device.

Where the vaporizable material is a liquid, a wicking element can draw the vaporizable material out of a reservoir holding the vaporizable material and into the vaporization chamber. Drawing of the vaporizable material into the vaporization chamber can be at least partially due to capillary action provided by the wick element as the wick element pulls the vaporizable material along the wick element in the direction of the vaporization chamber.

Vaporizer devices can be controlled by one or more controllers, electronic circuits (for example, sensors, heating elements), and/or the like on the vaporizer. Vaporizer devices can also wirelessly communicate with an external controller for example, a computing device such as a smartphone)

The quality of tobacco or vaporizable material can decrease over time when exposed to the atmosphere. Some vaporizer devices do not provide an airtight containment for tobacco or vaporizable material, which can decrease the quality of the tobacco and prevent even heating of the tobacco.

Some issues with current vaporizer devices include the inability to evenly heat vaporizable material, such as tobacco. Attempting to overcome such difficulties can, for example, undesirably result in higher manufacturing costs.

SUMMARY

In certain aspects of the current subject matter, challenges associated with efficiently and effectively forming an inhalable aerosol from various vaporizable materials including non-liquid vaporizable materials can be addressed by inclusion of one or more of the features described herein or comparable/equivalent approaches as would be understood by one of ordinary skill in the art. Aspects of the current subject matter relate to methods and system associated with a vaporizable material insert for inserting in a vaporizer device to form an inhalable aerosol.

In one aspect, a system for generating an inhalable aerosol is described. The system can include an insert having a jacket defining an inner chamber and vaporizable material contained in the inner chamber. The system can include a vaporizer device including a compartment configured to receive the insert and a heating element configured to heat the insert positioned in the compartment to generate the inhalable aerosol.

In some variations, one or more of the following features may optionally be included in any feasible combination. The jacket can be made out of the vaporizable material. The jacket can include a through hole configured to allow air to pass into and/or out of the insert. The jacket can be configured to prevent passage of air through the insert until heated or degenerated due to heating. The vaporizable material can include a plant material and/or a plant material based product. The vaporizable material can include a tobacco leaf and/or a reconstituted tobacco. The vaporizable material can include a gel material. The vaporizable material can include a sponge at least partly saturated with a liquid vaporizable material.

In some variations, the heating element can include an insert capturing and heating mechanism including a first foil heater coupled via a spring mechanism to a second foil heater. The spring mechanism can be configured to allow the first foil heater and second foil heater to transition between an open configuration and a closed configuration. The open configuration can allow the insert to be positioned between the first foil heater and second foil heater and the closed configuration can cause the first foil heater and second foil heater to at least partly conform to opposing sides of the insert for heating the insert to generate the inhalable aerosol. In some variations, the heating element can include an insert heater including a flexible heating element extending between pivoting supports. The pivoting supports can allow the insert heater to transition between an open configuration and a closed configuration. The open configuration can allow the flexible heating element to receive the insert and the closed configuration can allow the flexible heating element to wrap around at least a part of the insert for heating the insert to generate the inhalable aerosol. In some variations, the heating element can be coupled to a piercing member extending into the compartment of the vaporizer device. The piercing member can be configured to pierce the insert as the insert is inserted into the compartment thereby positioning the heating element within the inner chamber of the insert. In some variations, the heating element includes a coiled spring configured to extend around a circumference of the insert.

In another aspect, an insert configured to be inserted into a compartment of a vaporizer device is described. The insert can include a jacket forming an inner chamber. The insert can include a vaporizable material contained in the inner chamber, and each of the jacket and the vaporizable material can include a tobacco material.

In some variations, one or more of the following features may optionally be included in any feasible combination. The insert can include a heating element configured to heat the vaporizable material thereby generating an inhalable aerosol. The heating element can include a flat plate of electrically conductive material and at least a part of the heating element can be positioned within the inner chamber of the insert. The jacket can include a through hole configured to allow air to pass into and/or out of the insert. The jacket can be configured to prevent passage of air through the insert until heated or degenerated due to heating.

In another aspect, an insert for use with a vaporizer device is described. The insert can include a jacket forming an inner chamber, and the jacket can include a first vaporizable material. The insert can include a second vaporizable material contained in the inner chamber and a heating element in contact with one or both of the first vaporizable material and the second vaporizable material. The heating element can be configured to heat the first vaporizable material and the second vaporizable material to form an inhalable aerosol.

In some variations, one or more of the following features may optionally be included in any feasible combination. Each of the first vaporizable material and the second vaporizable material can include a non-liquid vaporizable material and/or a loose-leaf tobacco. The first vaporizable material and the second vaporizable material can include a sponge at least partly saturated with a liquid vaporizable material. In some variations the heating element can include a flat plate of electrically conductive material and at least a part of the heating element can be positioned within the inner chamber of the insert In yet another aspect, an insert for use with a vaporizer device is described that includes a jacket forming an inner chamber and a first vaporizable material contained in the inner chamber. The insert can include a second vaporizable material contained in the inner chamber and a heating element coupled to the jacket. The heating element can be configured to contact and heat the first vaporizable material and the second vaporizable material, and the heating of the first vaporizable material can form a first inhalable aerosol. The insert can further include an airflow pathway extending through the inner chamber to allow the first inhalable aerosol to be infused with a part of the second vaporizable material and form a second inhalable aerosol for inhalation by a user.

In some variations, one or more of the following features may optionally be included in any feasible combination. The insert can further include a filter positioned upstream a first region containing the first vaporizable material, the filter being configured to contain the second vaporizable material. The filter can be made out of a cotton material. The second vaporizable material can include one or more of a propylene glycol and a vegetable glycerin based liquid. The jacket can be made out of a third vaporizable material. The heating element can extend around a circumference of the jacket. The second vaporizable material can include a liquid vaporizable material. The first vaporizable material can include a non-liquid vaporizable material. The first vaporizable material can include a sponge at least partly saturated with a liquid vaporizable material. The heating element can directly contact either the first vaporizable material or the second vaporizable material.

In another interrelated aspect of the current subject matter, a method for generating an inhalable aerosol for inhalation by a user includes receiving an insert into a compartment of a vaporizer device. The insert can include a jacket forming an inner chamber configured to contain a vaporizable material. The method can further include activating a heating element configured to heat the vaporizable material and forming, as a result of the activating and heating of the vaporizable material, the inhalable aerosol.

In some variations, one or more of the following features may optionally be included in any feasible combination. The insert can include the heating element. The vaporizer device can include the heating element. The insert can include a biodegradable material. The vaporizable material can include a non-liquid vaporizable material. The vaporizable material can include tobacco.

The details of one or more variations of the subject matter described herein are set forth in the accompanying drawings and the description below. Other features and advantages of the subject matter described herein will be apparent from the description and drawings, and from the claims. The claims that follow this disclosure are intended to define the scope of the protected subject matter.

BRIEF DESCRIPTION OF THE DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Implementations of the current subject matter include methods, apparatuses, articles of manufacture, and systems relating to vaporization of one or more vaporizable materials for inhalation by a user. Example implementations include vaporizer devices and systems including vaporizer devices. The term "vaporizer device" as used in the following description and claims refers to any of a self-contained apparatus, an apparatus that includes two or more separable parts (for example, a vaporizer body that includes a battery and other hardware, and a cartridge that includes a vaporizable material), and/or the like. A "vaporizer system," as used herein, can include one or more components, such as a vaporizer device. Examples of vaporizer devices consistent with implementations of the current subject matter include electronic vaporizers, electronic nicotine delivery systems (ENDS), and/or the like. In general, such vaporizer devices are hand-held devices that heat (such as by convection, conduction, radiation, and/or some combination thereof) a vaporizable material to provide an inhalable dose of the material.

The vaporizable material used with a vaporizer device can be provided within a cartridge (for example, a part of the vaporizer that contains the vaporizable material) which can be refillable when empty, or disposable such that a new cartridge containing additional vaporizable material of a same or different type can be used. A vaporizer device can be a cartridge-using vaporizer device, a cartridge-less vaporizer device, or a multi-use vaporizer device capable of use with or without a cartridge. For example, a vaporizer device can include a heating chamber or compartment (for example, a chamber in which vaporizable material is heated by a heating element) configured to receive a vaporizable material.

In some implementations, a vaporizer device can be configured for use with a liquid vaporizable material (for example, a carrier solution in which an active and/or inactive ingredient(s) are suspended or held in solution, or a liquid form of the vaporizable material itself) and/or a non-liquid vaporizable material (e.g., a paste, a wax, a solid, a plant material, and/or the like). A non-liquid vaporizable material can include a plant material that emits some part of the plant material as the vaporizable material (for example, some part of the plant material remains as waste after the material is vaporized for inhalation by a user) or optionally can be a solid form of the vaporizable material itself, such that all of the solid material can eventually be vaporized for inhalation. A liquid vaporizable material can likewise be capable of being completely vaporized, or can include some portion of the liquid material that remains after all of the material suitable for inhalation has been vaporized.

Figure 1A:
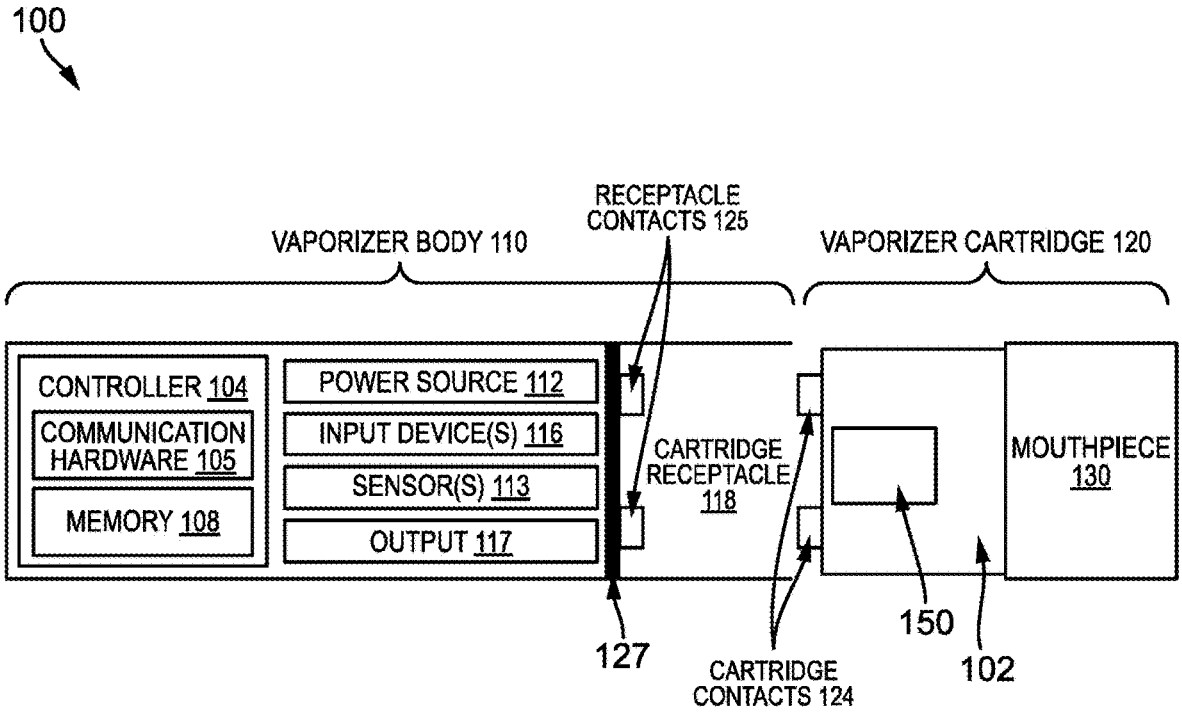
FIG. 1A is a block diagram of a vaporizer consistent with implementations of the current subject matter.

FIG. 1A depicts a block diagram illustrating an example of a vaporizer device 100 consistent with implementations of the current subject matter. Referring to FIG. 1A, the vaporizer device 100 can include a power source 112 (for example, a battery, which can be a rechargeable battery), and a controller 104 (for example, a processor, circuitry, etc. capable of executing logic) for controlling delivery of heat from a heating element 150 to cause a vaporizable material 102 to be converted from a condensed form (such as a solid, a liquid, a solution, a suspension, a part of an at least partially unprocessed plant material, etc.) to the gas phase. The controller 104 can be part of one or more printed circuit boards (PCBs) consistent with certain implementations of the current subject matter. After conversion of the vaporizable material 102 to the gas phase, at least some of the vaporizable material 102 in the gas phase can condense to form particulate matter in at least a partial local equilibrium with the gas phase as part of an aerosol, which can form some or all of an inhalable dose provided by the vaporizer device 100 during a user's puff or draw on the vaporizer device 100. It should be appreciated that the interplay between gas and condensed phases in an aerosol generated by a vaporizer device 100 can be complex and dynamic, due to factors such as ambient temperature, relative humidity, chemistry, flow conditions in airflow paths (both inside the vaporizer and in the airways of a human or other animal), and/or mixing of the vaporizable material 102 in the gas phase or in the aerosol phase with other air streams, which can affect one or more physical parameters of an aerosol. In some vaporizer devices, and particularly for vaporizer devices configured for delivery of volatile vaporizable materials, the inhalable dose can exist predominantly in the gas phase (for example, formation of condensed phase particles can be very limited).

The heating element 150 can include one or more of a conductive heater, a radiative heater, and/or a convective heater. One type of heating element is a resistive heating element, which can include a material (such as a metal or alloy, for example a nickel-chromium alloy, or a non-metallic resistor) configured to dissipate electrical power in the form of heat when electrical current is passed through one or more resistive segments of the heating element. In some implementations of the current subject matter, the heating element 150 (e.g., a resistive heating element and/or the like) is configured to generate heat for vaporizing the vaporizable material 102 to generate an inhalable dose of the vaporizable material 102. As noted, the vaporizable material 102 may be a liquid or non-liquid (or combination of both liquid and non-liquid). For example, the heating element 150 may be wrapped around, positioned within, integrated into a bulk shape of, pressed into thermal contact with, or otherwise arranged to deliver heat to the vaporizable material 102 to be vaporized for subsequent inhalation by a user in a gas and/or a condensed (for example, aerosol particles or droplets) phase.

In some embodiments, the vaporizable material 102 may be a non-liquid vaporizable material including, for example, a solid-phase material (such as a wax or the like) or plant material (e.g., tobacco leaves and/or parts of tobacco leaves). Where the vaporizable material 102 is a non-liquid vaporizable material, the heating element 150 can be part of, or otherwise incorporated into or in thermal contact with, the walls of a heating chamber or compartment (e.g., cartridge receptacle 118) into which the vaporizable material 102 is placed. Alternatively, the heating element 150 can be used to heat air passing through or past the vaporizable material 102, to cause convective heating of the vaporizable material 102. In still other examples, the heating element 150 can be disposed in intimate contact with the vaporizable material 102 such that direct conductive heating of the vaporizable material 102 occurs from within a mass of the vaporizable material 102, as opposed to only by conduction inward from walls of the heating chamber (e.g., an oven and/or the like). In some embodiments, the heating element 150 can be a part of the vaporizer cartridge 120, as shown in FIG. 1A. In some embodiments, the heating element 150 can be a part of the vaporizer body 110 (e.g., part of the durable or reusable part of the vaporizer 100).

The heating element 150 can be activated in association with a user puffing (e.g., drawing, inhaling, etc.) on a mouthpiece 130 of the vaporizer device 100 to cause air to flow from an air inlet, along an airflow path for assisting with forming an inhalable aerosol that can be delivered out through an air outlet in the mouthpiece 130. Incoming air moving along the airflow path moves over or through the heating element 150 and/or vaporizable material 102 where vaporizable material 102 in the gas phase is entrained into the air. The heating element 150 can be activated via the controller 104, which can optionally be a part of the vaporizer body 110 as discussed herein, causing current to pass from the power source 112 through a circuit including the heating element 150, which is optionally part of the vaporizer cartridge 120. As noted herein, the entrained vaporizable material 102 in the gas phase can condense as it passes through the remainder of the airflow path such that an inhalable dose of the vaporizable material 102 in an aerosol form can be delivered from the air outlet (for example, the mouthpiece 130) for inhalation by a user.

Activation of the heating element 150 can be caused by automatic detection of a puff based on one or more signals generated by one or more sensor(s) 113. The sensor 113 and the signals generated by the sensor 113 can include one or more of: a pressure sensor or sensors disposed to detect pressure along the airflow path relative to ambient pressure (or optionally to measure changes in absolute pressure), a motion sensor or sensors (for example, an accelerometer) of the vaporizer device 100, a flow sensor or sensors of the vaporizer device 100, a capacitive lip sensor of the vaporizer device 100, detection of interaction of a user with the vaporizer device 100 via one or more input devices 116 (for example, buttons or other tactile control devices of the vaporizer device 100), receipt of signals from a computing device in communication with the vaporizer device 100, and/or via other approaches for determining that a puff is occurring or imminent.

As discussed herein, the vaporizer device 100 consistent with implementations of the current subject matter can be configured to connect (such as, for example, wirelessly or via a wired connection) to a computing device (or optionally two or more devices) in communication with the vaporizer device 100. To this end, the controller 104 can include communication hardware 105. The controller 104 can also include a memory 108. The communication hardware 105 can include firmware and/or can be controlled by software for executing one or more cryptographic protocols for the communication.

A computing device can be a component of a vaporizer system that also includes the vaporizer device 100, and can include its own hardware for communication, which can establish a wireless communication channel with the communication hardware 105 of the vaporizer device 100. For example, a computing device used as part of a vaporizer system can include a general-purpose computing device (such as a smartphone, a tablet, a personal computer, some other portable device such as a smartwatch, or the like) that executes software to produce a user interface for enabling a user to interact with the vaporizer device 100. In other implementations of the current subject matter, such a device used as part of a vaporizer system can be a dedicated piece of hardware such as a remote control or other wireless or wired device having one or more physical or soft (e.g., configurable on a screen or other display device and selectable via user interaction with a touch-sensitive screen or some other input device like a mouse, pointer, trackball, cursor buttons, or the like) interface controls. The vaporizer device 100 can also include one or more outputs 117 or devices for providing information to the user. For example, the outputs 117 can include one or more light emitting diodes (LEDs) configured to provide feedback to a user based on a status and/or mode of operation of the vaporizer device 100.

In the example in which a computing device provides signals related to activation of the heating element, or in other examples of coupling of a computing device with the vaporizer device 100 for implementation of various control or other functions, the computing device executes one or more computer instruction sets to provide a user interface and underlying data handling. In one example, detection by the computing device of user interaction with one or more user interface elements can cause the computing device to signal the vaporizer device 100 to activate the heating element to reach an operating temperature for creation of an inhalable dose of vapor/aerosol. Other functions of the vaporizer device 100 can be controlled by interaction of a user with a user interface on a computing device in communication with the vaporizer device 100.

The temperature of the heating element 150 of the vaporizer device 100 can depend on a number of factors, including an amount of electrical power delivered to the heating element 150 and/or a duty cycle at which the electrical power is delivered, conductive heat transfer to other parts of the vaporizer device 100 and/or to the environment, latent heat losses due to vaporization of the vaporizable material 102, and convective heat losses due to airflow (e.g., air moving across the heating element 150 when a user inhales on the vaporizer device 100). As noted herein, to reliably activate the heating element 150 or heat the heating element 150 to a desired temperature, the vaporizer device 100 may, in some implementations of the current subject matter, make use of signals from the sensor 113 (for example, a pressure sensor) to determine when a user is inhaling. The sensor 113 can be positioned in the airflow path and/or can be connected (for example, by a passageway or other path) to an airflow path containing an inlet for air to enter the vaporizer device 100 and an outlet via which the user inhales the resulting vapor and/or aerosol such that the sensor 113 experiences changes (for example, pressure changes) concurrently with air passing through the vaporizer device 100 from the air inlet to the air outlet. In some implementations of the current subject matter, the heating element 150 can be activated in association with a user's puff, for example by automatic detection of the puff, or by the sensor 113 detecting a change (such as a pressure change) in the airflow path.

The sensor 113 can be positioned on or coupled to (e.g., electrically or electronically connected, either physically or via a wireless connection) the controller 104 (for example, a printed circuit board assembly or other type of circuit board). To take measurements accurately and maintain durability of the vaporizer device 100, it can be beneficial to provide a seal 127 resilient enough to separate an airflow path from other parts of the vaporizer device 100. The seal 127, which can be a gasket, can be configured to at least partially surround the sensor 113 such that connections of the sensor 113 to the internal circuitry of the vaporizer device 100 are separated from a part of the sensor 113 exposed to the airflow path. Such arrangements of the seal 127 in the vaporizer device 100 can be helpful in mitigating against potentially disruptive impacts on vaporizer components resulting from interactions with environmental factors such as water in the vapor or liquid phases and/or to reduce the escape of air from the designated airflow path in the vaporizer device 100. Unwanted air, liquid or other fluid passing and/or contacting circuitry of the vaporizer device 100 can cause various unwanted effects, such as altered pressure readings, and/or can result in the buildup of unwanted material, such as moisture, errant portions of the vaporizable material 102, etc., in parts of the vaporizer device 100 where they can result in poor pressure signal, degradation of the sensor 113 or other components, and/or a shorter life of the vaporizer device 100. Leaks in the seal 127 can also result in a user inhaling air that has passed over parts of the vaporizer device 100 containing, or constructed of, materials that may not be desirable to be inhaled.

In some implementations, the vaporizer body 110 includes the controller 104, the power source 112 (for example, a battery), one more of the sensor 113, charging contacts (such as those for charging the power source 112), the seal 127, and a cartridge receptacle 118 configured to receive the vaporizer cartridge 120 for coupling with the vaporizer body 110 through one or more of a variety of attachment structures. In some examples, the vaporizer cartridge 120 includes a jacket (e.g., made out of biodegradable material) for containing the vaporizable material 102, and the mouthpiece 130 has an aerosol outlet for delivering an inhalable dose to a user. In some embodiments, the mouthpiece 130 is a part of the vaporizer body 110.

In an embodiment of the vaporizer device 100 in which the power source 112 is part of the vaporizer body 110, and a heating element 150 is disposed in the vaporizer cartridge 120 and configured to couple with the vaporizer body 110, the vaporizer device 100 can include electrical connection features (for example, means for completing a circuit) for completing a circuit that includes the controller 104 (for example, a printed circuit board, a microcontroller, or the like), the power source 112, and the heating element 150. These features can include one or more contacts (e.g., cartridge contacts 124*a* and 124*b*) on a bottom surface of the vaporizer cartridge 120 and at least two contacts (e.g., receptacle contacts 125*a* and 125*b*) disposed near a base of a compartment or receptacle (e.g., the cartridge receptacle 118) of the vaporizer device 100 such that the cartridge contacts 124*a* and 124*b* and the receptacle contacts 125*a* and 125*b* make electrical connections when, for example, the vaporizer cartridge 120 is inserted into and coupled with the cartridge receptacle 118. The circuit completed by these electrical connections can allow delivery of electrical current to the heating element 150 and can further be used for additional functions, such as measuring a resistance of the heating element 150 for use in determining and/or controlling a temperature of the heating element 150 based on a thermal coefficient of resistivity of the heating element. In some implementations, the vaporizer body 110 includes the heating element 150 such that the cartridge receptacle 118 and vaporizer cartridge 120 do not include one or more contacts. For example, in some embodiments the cartridge receptacle 118 includes the heating element 150 coupled to the power source 112.

In some implementations of the current subject matter, the cartridge contacts 124*a* and 124*b* and the receptacle contacts 125*a* and 125*b* can be configured to electrically connect in either of at least two orientations. In other words, one or more circuits necessary for operation of the vaporizer device 100 can be completed by insertion of the vaporizer cartridge 120 into the cartridge receptacle 118 in a first rotational orientation (around an axis along which the vaporizer cartridge 120 is inserted into the cartridge receptacle 118 of the vaporizer body 110) such that the cartridge contact 124*a* is electrically connected to the receptacle contact 125*a* and the cartridge contact 124*b* is electrically connected to the receptacle contact 125*b*. Furthermore, the one or more circuits necessary for operation of the vaporizer device 100 can be completed by insertion of the vaporizer cartridge 120 in the cartridge receptacle 118 in a second rotational orientation such cartridge contact 124*a* is electrically connected to the receptacle contact 125*b* and cartridge contact 124*b* is electrically connected to the receptacle contact 125*a*.

In some implementations, the vaporizer cartridge 120, or at least an insertable end 122 of the vaporizer cartridge 120 configured for insertion in the cartridge receptacle 118, can have a non-circular cross section transverse to the axis along which the vaporizer cartridge 120 is inserted into the cartridge receptacle 118. For example, the non-circular cross section can be approximately rectangular, approximately elliptical (e.g., have an approximately oval shape), non-rectangular but with two sets of parallel or approximately parallel opposing sides (e.g., having a parallelogram-like shape), or other shapes having rotational symmetry of at least order two. In this context, approximate shape indicates that a basic likeness to the described shape is apparent, but that sides of the shape in question need not be completely linear and vertices need not be completely sharp. Rounding of both or either of the edges or the vertices of the cross-sectional shape is contemplated in the description of any non-circular cross section referred to herein.

The cartridge contacts 124*a* and 124*b* and the receptacle contacts 125*a* and 125*b* can take various forms. For example, one or both sets of contacts can include conductive pins, tabs, posts, receiving holes for pins or posts, or the like. Some types of contacts can include springs or other features to facilitate better physical and electrical contact between the contacts on the vaporizer cartridge 120 and the vaporizer body 110. The electrical contacts can optionally be gold-plated, and/or include other materials.

Figure 1B:
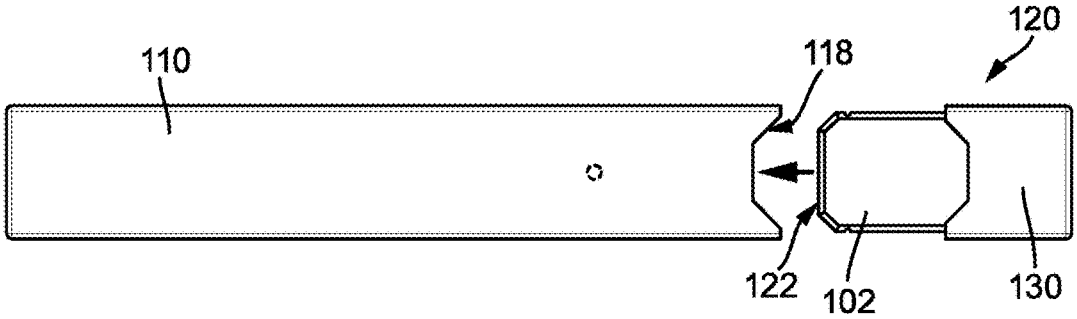
FIG. 1B is a top view of an embodiment of the vaporizer of FIG. 1A showing a cartridge separated from a vaporizer device body.

FIG. 1B illustrates an embodiment of the vaporizer body 110 having a cartridge receptacle 118 into which the vaporizer cartridge 120 may be releasably inserted. FIG. 1B shows a top view of the vaporizer 100 illustrating the vaporizer cartridge 120 being positioned for insertion into the vaporizer body 110. When a user puffs on the vaporizer 100, air may pass between an outer surface of the vaporizer cartridge 120 and an inner surface of a cartridge receptacle 118 on the vaporizer body 110. Air can then be drawn into through at least a part of the vaporizer cartridge and out through an outlet of the mouthpiece 130 for delivery of the inhalable aerosol to a user.

In some embodiments, the vaporizer device 100 can be configured to heat a non-liquid vaporizable material including, for example, a plant material (e.g., tobacco leaves), a plant material based product (e.g., reconstituted tobacco) and/or the like. For example, some embodiments of the vaporizer body 110 of the vaporizer device 100 can be configured to receive an embodiment of a vaporizer cartridge 120 that is at least partly made out of and/or includes a non-liquid vaporizable material. Embodiments of the vaporizer cartridge 120 that are at least partly made out of and/or include non-liquid vaporizable material may be referred to herein as an "insert". As such, any insert embodiment described herein can include any one or more of the features described herein related to the vaporizer cartridge (such as with respect to FIGS. 1A and 1B). Similarly, any vaporizer cartridge embodiment described herein can include any one or more of the features described herein related to the insert.

In some embodiments, the insert can include a jacket (e.g., made out of a biodegradable material) that defines an inner chamber configured to contain the non-liquid vaporizable material. As such, some embodiments of the cartridge receptacle 118 can be configured to receive and heat various embodiments of an insert, such as for forming an inhalable aerosol. For example, an embodiment of the cartridge receptacle 118 can include a compartment that is configured for receiving and heating a variety of inserts, as will be described below. As such, the compartment can include any one or more of the features described herein related to the cartridge receptacle 118 (such as with respect to FIGS. 1A and 1B), as well as include one or more features that are configured to receive and/or heat an insert or vaporizer cartridge embodiment that is made out of and/or includes non-liquid vaporizable material.

In some embodiments, the compartment can include all or part of the heating element 150 (e.g., a heating coil, etc.) that is configured to heat the insert received in the compartment, such as for forming the inhalable aerosol. In some embodiments, the insert can include a part of the heating element 150, such as include a thermally conductive material. Some insert embodiments including a part of the heating element 150 can also include one or more insert contacts (e.g., cartridge contacts 124) that, when the insert is inserted into the compartment, can couple to one or more receptacle contacts 125 to allow activation of the part of the heating element 150 of the insert, such as for heating the insert for forming inhalable aerosol. Various insert embodiments are described herein for use with a variety of vaporizer devices 100. Various embodiments of heating elements 150 and compartments are also described herein for heating and containing various insert embodiments, such as for forming inhalable aerosol.

Figure 2A:
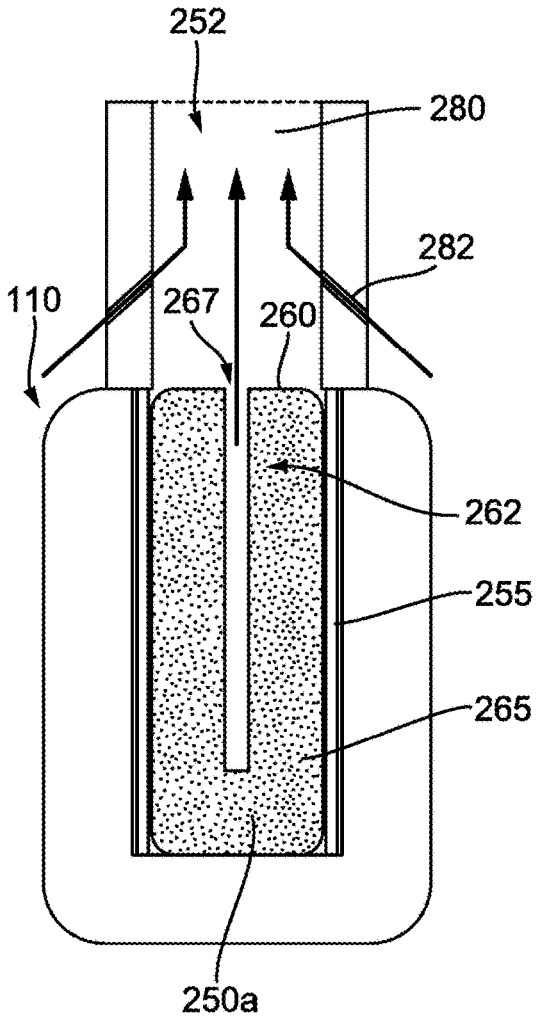
FIG. 2A illustrates a cross section view of an embodiment of an insert inserted in a compartment of a vaporizer body.
Figure 2B:
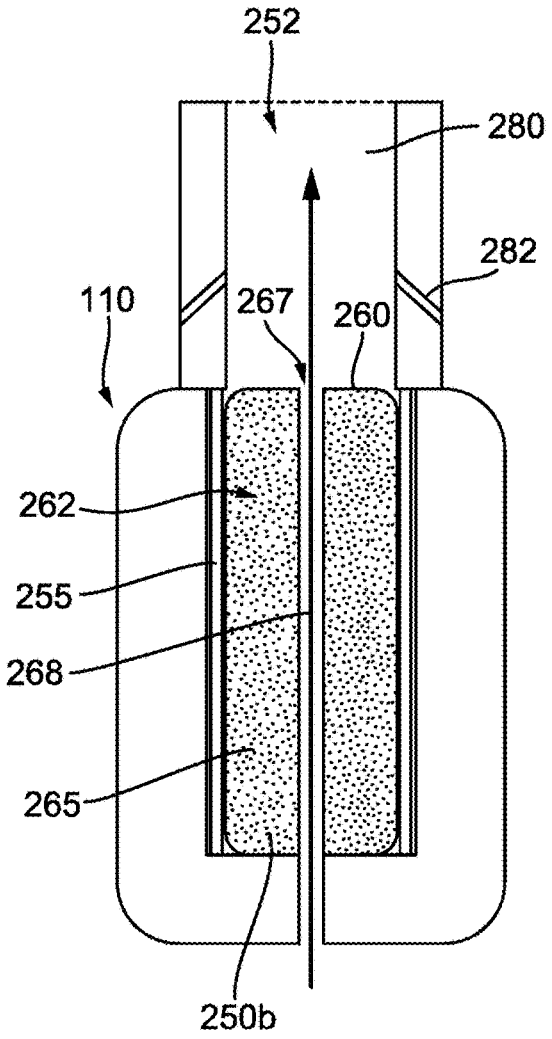
FIG. 2B illustrates a cross section view of another embodiment of an insert inserted in a compartment of a vaporizer device.

FIGS. 2A and 2B illustrate embodiments of an insert 250*a* and 250*b*, respectively, positioned within a compartment 252 of a vaporizer body 110 of a vaporizer device 100. The compartment 252 can include a heating element 255, thereby allowing the heating element 255 to be included in the durable/reusable vaporizer body 110. As shown in FIGS. 2A and 2B, the heating element 255 can be positioned adjacent and/or along one or more sides of the compartment 252. As such, when the insert 250 is positioned in the compartment 252, the heating element 255 can be adjacent and/or in contact with the insert 250*a*, 250*b*, thereby allowing the heating element 255 to efficiently and effectively heat the insert 250*a*, 250*b* for forming an inhalable aerosol. The heating element 255 can extend substantially around a circumference and/or along a length of the insert 250*a*, 250*b*. The compartment 252, including the heating element 255, can include various features and shapes for containing and heating the insert 250*a*, 250*b*, as will be described herein. Various embodiments of the heating element 255 are within the scope of this disclosure to allow for efficient and effective heating of the insert 250*a*, 250*b*.

As shown in FIGS. 2A and 2B, the insert 250*a*, 250*b* can include a jacket 260 that forms an inner chamber 262 configured to contain a vaporizable material 265. The vaporizable material 265 may be a non-liquid vaporizable material including, for example, a plant material (e.g., tobacco leaves), a plant material based product (e.g., reconstituted tobacco), and/or the like. In some embodiments, the vaporizable material may include a sponge that is at least partly saturated with a liquid vaporizable material. In some embodiments, the jacket 260 can fully or substantially contain the vaporizable material 265. In some embodiments, the jacket 260 can be made of a material that prevents passage of air through the material (e.g., until heated or degenerated due to heating) to thereby prevent air from effecting the quality of the vaporizable material 265 contained within the jacket 260. For example, some embodiments of the jacket 260 can be completely sealed to prevent the passage of air into the inner chamber 262 until the jacket 260 is heated or degenerated due to heating.

In some embodiments, the jacket 260 can include one or more air passageways or through holes 267 that allow air to pass into and/or out of the insert 250*a*, 250*b*. For example, the insert 250*a*, 250*b* may be completely sealed except for one through hole 267 that extends through the wall of the jacket 260. As shown in FIG. 2A, the insert 250*a* can include a through hole 267 that extends through the jacket 260 at a first end to allow aerosol to be directed out of the insert 250*a*, such as for inhalation by a user. As shown in FIG. 2B, the insert 250*b* can include two through holes 267 that extend through the jacket 260 (e.g., on opposing ends of the insert 250*b*) and form an airflow passageway 268 therebetween. The airflow passageway 268 can allow airflow to pass therealong and allow aerosol formed in the insert 250*b* to be directed out of the insert 250*b*, such as for inhalation by a user. The one or more through holes 267 and/or airflow passageway 268 can be formed prior to or upon insertion of the insert 250*a*, 250*b* into the compartment 252 of the vaporizer body 110. For example, the one or more through holes 267 can be formed upon insertion of the insert 250*a*, 250*b* into the compartment. This can improve and maintain freshness and quality of the vaporizable material 265 within the insert 250*a*, 250*b*.

In some embodiments, the jacket 260 of the insert 250*a*, 250*b* can be made out of a non-liquid vaporizable material. The vaporizable material may be a non-liquid vaporizable material including, for example, a plant material (e.g., tobacco leaves), a plant material based product (e.g., reconstituted tobacco), and/or the like. As such, the jacket 260 can be included as part of the consumable that produces aerosol, such as for inhalation by a user. In some embodiments, at least part of the jacket 260 can be made out of a thermally conductive material, such as a metal or aluminum foil. As such, the heating element 255 can contact (e.g., via one or more electrical contacts) and/or heat the thermally conductive jacket. The heated thermally conductive jacket can then substantially and evenly heat the vaporizable material 265 contained within the jacket 260, which can result in a favorable heating of the vaporizable material 265 for achieving efficient and effective inhalable aerosol formation. Such even heating can provide for effective repeated start-and-stop heating of the vaporizable material 265 within the jacket 260.

In some embodiments, the jacket 260 is made out of a non-permeable membrane. In some embodiments, at least a part of the heating element 255 can be included in the insert. Other materials and embodiments of the insert and jacket are within the scope of this disclosure.

As shown in FIG. 2A, the insert 250*a* can be inserted in a compartment 252 of a vaporizer body 110. An open end 280 of the compartment 252 can include at least one vent hole 282 that allows air to pass therethrough, such as from outside of the vaporizer device 100 to an airflow pathway extending along the vaporizer device 100 (e.g., through the open end 280). As such, when a user takes a puff from the vaporizer device 100, air can be drawn in through the vent holes 282 which can also draw up inhalable aerosol from the insert (e.g., through the through hole 267 along the insert 250*a*), such as to allow a user to inhale the inhalable aerosol.

As shown in FIG. 2B, the airflow passageway 268 of the insert 250*b* can approximately align with an inlet 284 of an embodiment of the compartment 252. As such, when a user takes a puff from the vaporizer device 100, air can be drawn through the inlet 284 and into the compartment 252 to pass along the airflow passageway 268 of the insert 250*b* to allow inhalable aerosol to form and travel out from the vaporizer body 110, such as for inhalation by a user.

The compartment 252 can include a variety of shapes and sizes for effectively accepting an insert for heating and forming an inhalable aerosol. For example, the compartment 252 can provide a sliding or friction fit along at least one side of the insert, such as for ensuring efficient and effective heating of the insert and securing placement of the insert in the compartment 252.

Figure 3:
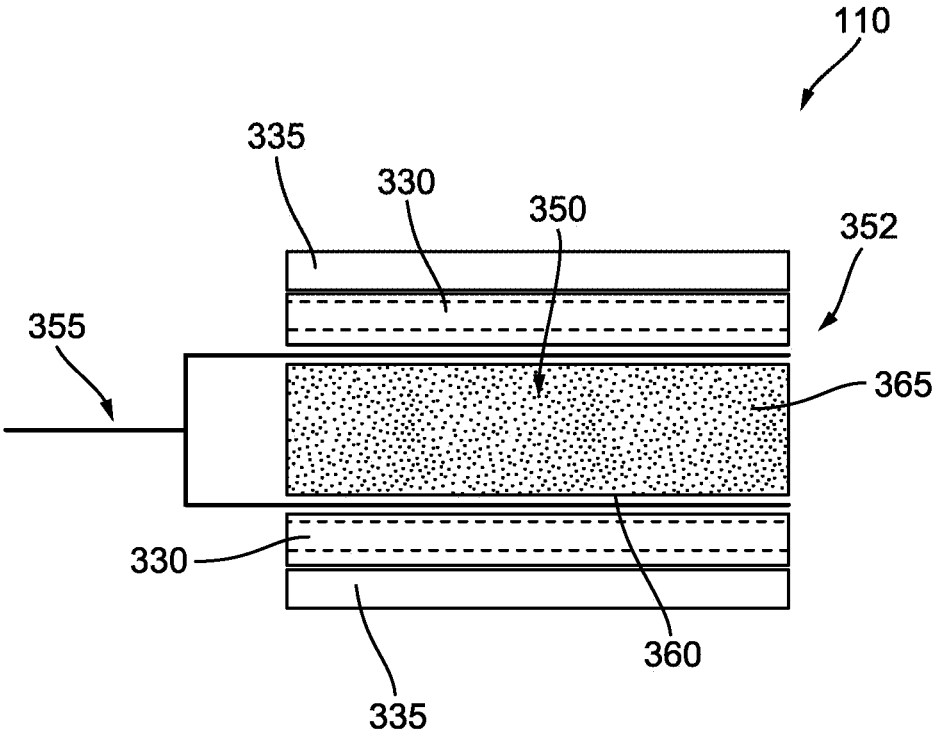
FIG. 3 illustrates another embodiment of an insert inserted in a compartment of a vaporizer device.

FIG. 3 illustrates another embodiment of an insert 350 inserted into a compartment 352 of a vaporizer device 100. For example, the insert 350 can include a jacket 360 made out of a loose-leaf plant material or a plant material based product wrapped in a wrapping medium such as aluminum foil, paper, plant fiber, plant material (e.g. tobacco), Kapton tape, or other type of insulation and protection layer.

As shown in FIG. 3, the compartment 352 can be at least partially surrounded by an insulation layer 330 including an insulating material (e.g., Nomex insulation). The insulation layer 330 can assist with containing heat from a heating element 355 associated with the compartment 352 such that the heat is substantially used to heat the insert positioned within the compartment 352. Additionally, at least one compaction plate 335 can be positioned along an outer side of the insulation layer 330 to contain and secure the insulation layer 330 to the compartment 352.

As shown in FIG. 3, the vaporizer device 100 can include a heating element 355 that extends along at least a part of a length of the compartment 352 and is configured to contact an outer surface of the jacket 360 of the insert 350. In some embodiments, the jacket 360 can include a heat conducting material (e.g., aluminum foil). Contact between the heating element 355 and the jacket 360 including a heat conducting material can provide efficient and effective heating of the vaporizable material 365 of the insert 350 for forming inhalable aerosol.

In the embodiment where the jacket 360 is made out of a thermally conductive material, thermal transfer can be improved along the vaporizable material contained in the jacket, thereby ensuring a more even heating of the vaporizable material. The vaporizable material may be a non-liquid vaporizable material including, for example, a plant material (e.g., tobacco leaves), a plant material based product (e.g., reconstituted tobacco), and/or the like. In some embodiments, the vaporizable material may include a sponge that is at least partly saturated with a liquid vaporizable material.

In some embodiments, the heating element may be integral to the jacket that is made out of an aluminum foil material. In some embodiments, the insert can include at least a portion of the heating element, thereby integrating the heating element with the consumable. In an embodiment where the jacket is formed at least in part from the non-vaporizable material and/or another biodegradable material (and the heater is part of the durable, vaporizer body), the insert can be considered biodegradable and part of the consumable.

FIGS. 4A-4D illustrates a vaporizer device 100 including an embodiment of a heating element including an insert capturing and heating mechanism 470 that is configured to capture and secure an insert 450 in the vaporizer 100, such as for heating and forming an inhalable aerosol. Once captured and secured, the capturing and heating mechanism 470 can be activated to heat and/or vaporize the insert 450 captured in the capturing and heating mechanism 470, such as for forming an inhalable aerosol.

Figure 4A:
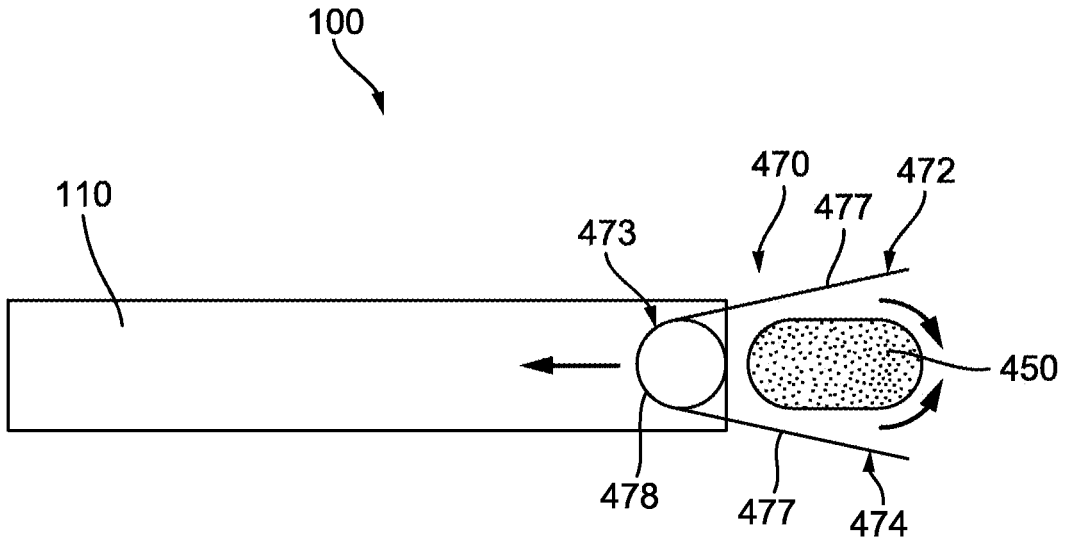
FIGS. 4A-4D illustrates a vaporizer device including an insert capturing and heating mechanism that is configured to capture and secure an insert in the vaporizer device.
Figure 4B:
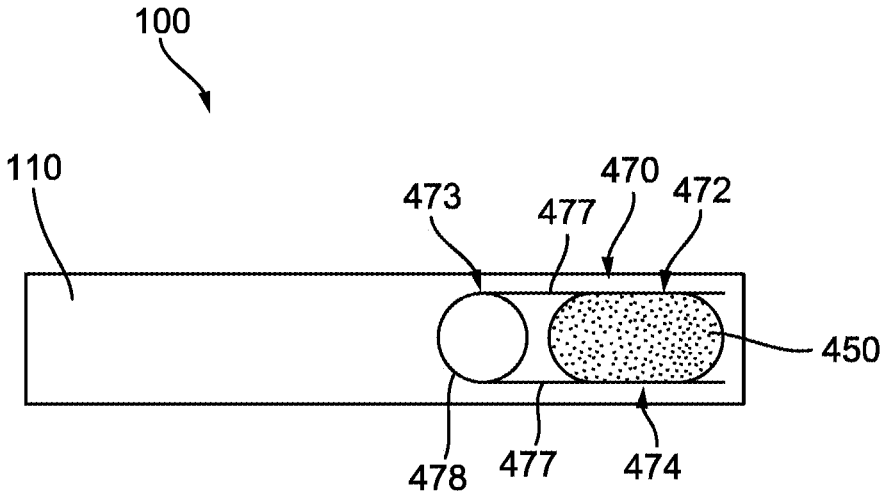
Figure 4C:
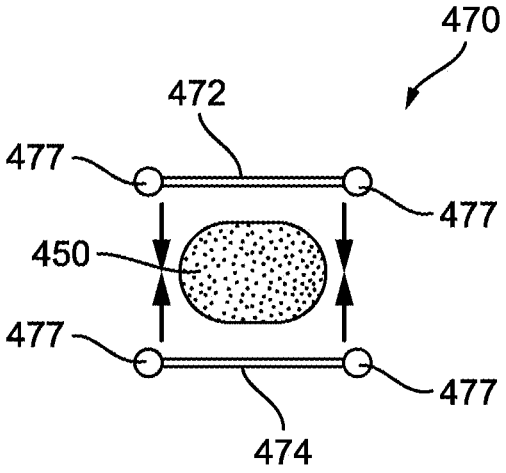
Figure 4D:
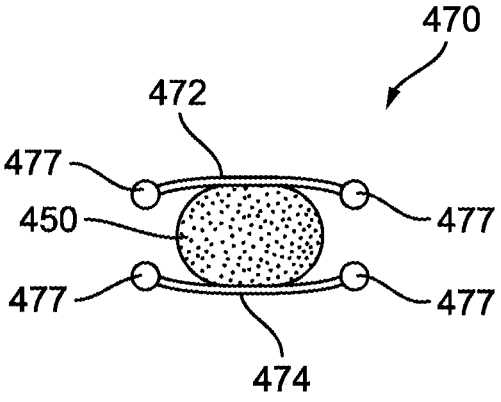

As shown in FIGS. 4A and 4B, the insert capturing and heating mechanism 470 can include a first foil heater 472 coupled via a spring mechanism 473 to a second foil heater 474. For example, the spring mechanism 473 can include a pair of arms 477 extending from a spring coil 478. As shown in FIGS. 4C and 4D, each of the first and second foil heaters 472, 474 can secure to and extend between a pair of arms 477 extending from the spring coil 478. Each pair of arms 477 of the spring mechanism 473 can provide a structural support for the first and second foil heaters 472, 474. Additionally, each pair of arms 477 can allow the first and second foil heaters 472, 474 to have sufficient structural support to capture an insert 450 therebetween, as well as for subsequent heating and/or vaporizing of the insert 450, as will be described in greater detail below.

FIG. 4A illustrates the insert capturing and heating mechanism 470 in an open configuration. In the open configuration the insert capturing and heating mechanism 470 can be positioned in a distal position along the vaporizer body 110 that allows the first and second foil heaters 472, 474 to pivot or spring open into an open configuration. For example, in the distal position, the insert capturing and heating mechanism 470 can extend at least partly from a distal end of the vaporizer body 110 such that the first and second foil heaters 472, 474 are not restrained from springing or pivoting to the open configuration. Additionally, the spring mechanism 473 of the insert capturing and heating mechanism 470 can bias the first and second foil heaters 472, 474 in the open configuration.

In the open configuration the insert 450 can be inserted between the first and second foil heaters 472, 474. Once positioned between the first and second foil heaters 472, 474, the insert capturing and heating mechanism 470 can be moved to a more proximal position along the vaporizer body 110 thereby moving the first and second foil heaters 472, 474 into a closed configuration with the insert 450 captured therebetween, as shown in FIG. 4B. For example, in the more proximal position, as shown in FIG. 4B, the spring mechanism 473 can be confined to a space within the vaporizer body 110 that forces the spring mechanism 473 to form the closed configuration.

The first and second foil heaters 472, 474 can be flexible such that each of the first and second foil heaters 472, 474 can at least partly conform to opposing sides of the insert 450 captured therebetween. For example, as shown in FIG. 4C, when the spring mechanism 473 is in the open configuration, the first and second foil heaters 472, 474 can extend approximately parallel to each other and be separated a distance that allows the insert 450 to be inserted therebetween. As shown in FIG. 4D, when the spring mechanism 473 is in the closed configuration, one or both of the first and second foil heaters 472, 474 can conform to a part of the insert 450, which can assist with securing and heating the insert 450 (e.g., conductive heating). Such additional contact can allow for effective and efficient heating of the insert 450 by the first and second foil heaters 472, 474. Although the insert capturing and heating mechanism 470 is described as including first and second foil heaters 472, 474, the heating component of the insert capturing and heating mechanism 470 can include various other heating components without departing from the scope of this disclosure.

Figure 5A:
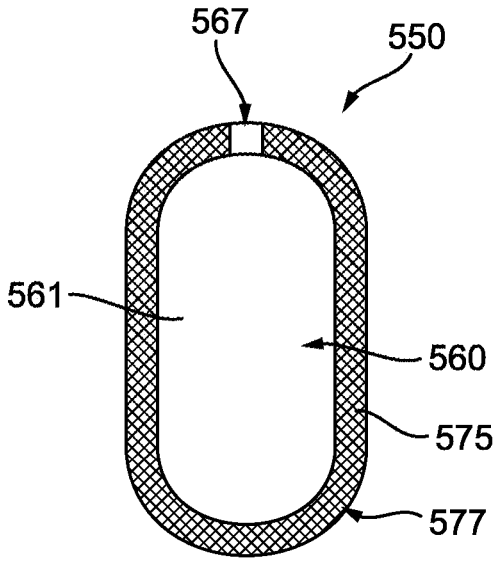
FIG. 5A illustrates a top view of another embodiment of an insert having an elongate circular outer profile.
Figure 5B:
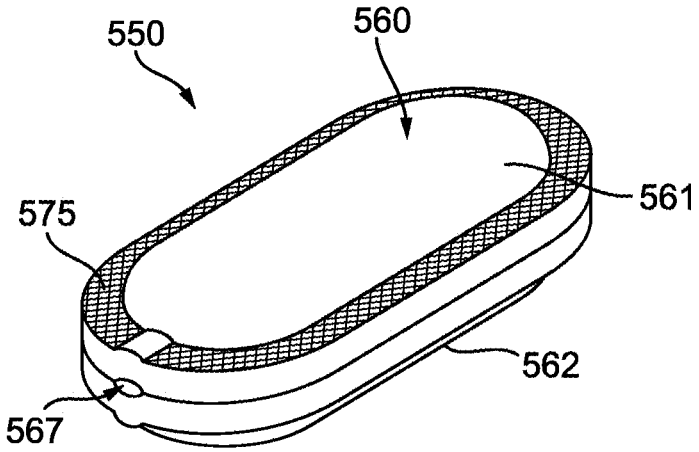
FIG. 5B illustrates a perspective end view of the insert of FIG. 5A.

FIGS. 5A and 5B illustrate another embodiment of an insert 550 including a jacket 560 formed of a first jacket component 561 and a second jacket component 562. For example, the first and second jacket components 561, 562 can each include a cylindrical shape and have a same or similar size. Both the first and second jacket components 561, 562 can include a perimeter 575 that can be sealed. For example, a perimeter area 577 of the first jacket component 561 can be sealed to a perimeter area 577 of the second jacket component 562 thereby forming an elongated or cylindrical inner chamber within the jacket 560. The inner chamber can be filled or substantially filled with a non-liquid vaporizable material. The vaporizable material 565 may be a non-liquid vaporizable material including, for example, a plant material (e.g., tobacco leaves), a plant material based product (e.g., reconstituted tobacco), and/or the like such as a loose-leaf tobacco. In some embodiments, the vaporizable material 565 may include a sponge that is at least partly saturated with a liquid vaporizable material. In some embodiments, the jacket 560 can be made out of a vaporizable material, such as including a tobacco material. The jacket 560 can be made out of and filled with a variety of materials without departing from the scope of this disclosure.

As mentioned above, some implementations of the insert 550 can include one or more through holes 567 extending through the jacket 560. The through hole 567 can be sized and shaped to control or limit the amount of air allowed to pass into or out of the insert 550. For example, the through hole 567 can be formed along the insert 560 via piercing the insert 560, such as during insertion of the insert 560 into the compartment of a vaporizer body 110.

In some implementations, by using a pressure build-up of a sealed volume formed in the insert, the aerosol formed within the inner chamber of the jacket can be expelled from the insert (e.g., via the through hole 567 extending through the jacket 560) without relying on airflow through the insert 550. This can reduce a risk of aerosol being sucked back into the vaporizer device 100 and causing contamination issues, such as at the end of a puff.

Figure 6A:
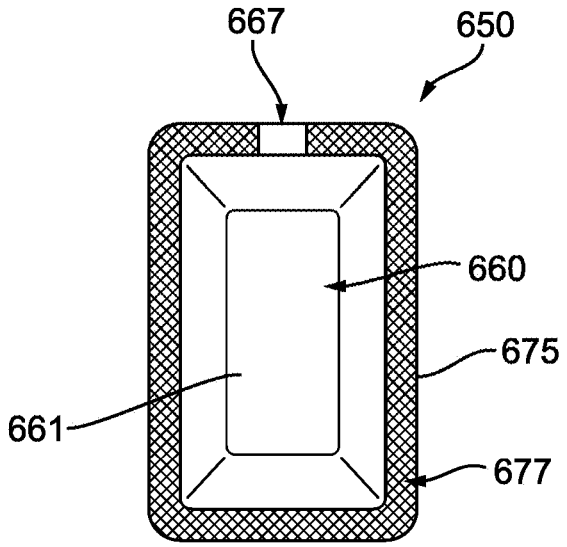
FIG. 6A illustrates a top view of another embodiment of an insert having a rectangular outer profile.
Figure 6B:
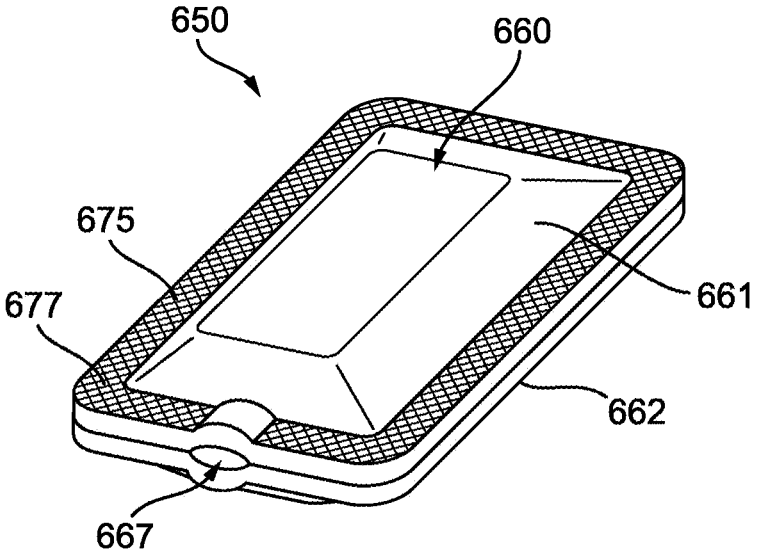
FIG. 6B illustrates a perspective end view of the insert of FIG. 6A.

FIGS. 6A and 6B illustrate another embodiment of an insert 650 including a jacket 660 formed of a first jacket component 661 and a second jacket component 662. For example, the first and second jacket components 661, 662 can include a square or rectangular shape and have a same or similar size. Both the first and second jacket components 561, 662 can include a perimeter 675 that can be sealed. For example, a perimeter area 677 of the first jacket component 661 can be sealed to a perimeter area 677 of the second jacket component 662 thereby forming an elongated or cylindrical inner chamber within the jacket 660. The inner chamber can be filled or substantially filled with a non-liquid vaporizable material. The non-liquid vaporizable material can include, for example, a plant material (e.g., tobacco leaves), a plant material based product (e.g., reconstituted tobacco), and/or the like. In some embodiments, the vaporizable material may include a sponge that is at least partly saturated with a liquid vaporizable material. In some embodiments, the jacket 660 can be made out of a non-liquid vaporizable material, such as any of the non-liquid vaporizable materials described herein. The jacket 660 can be made out of and filled with a variety of materials without departing from the scope of this disclosure.

As shown in FIGS. 6A-6B, the insert 650 can include one or more through holes 667 extending through the jacket 660. The through hole 667 can be sized and shaped to control or limit the amount of air allowed to pass into or out of the insert 650. For example, the through hole 667 can be formed along the insert 660 via piercing the insert 660, such as during insertion of the insert 660 into the compartment of a vaporizer body 110.

Figure 7A:
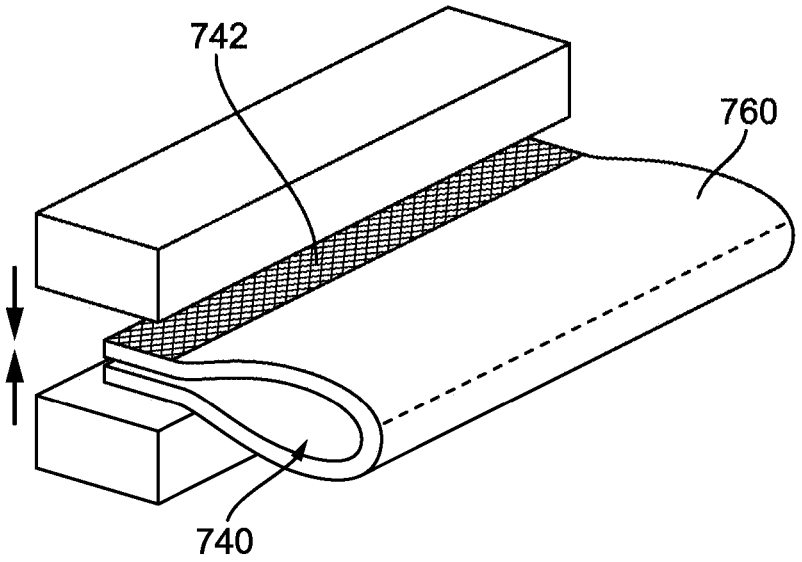
FIGS. 7A-7D illustrate a method of manufacturing an embodiment of an insert.
Figure 7B:
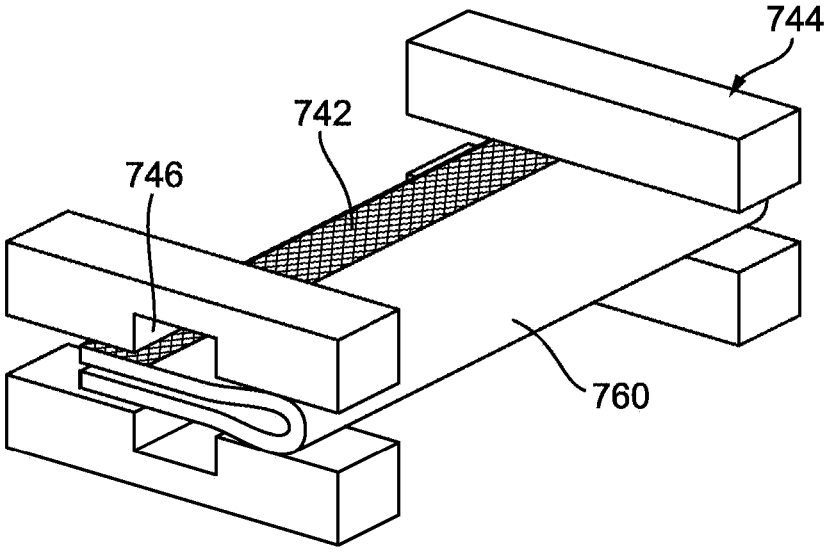
Figure 7C:
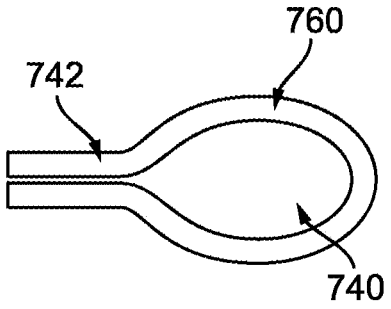
Figure 7D:
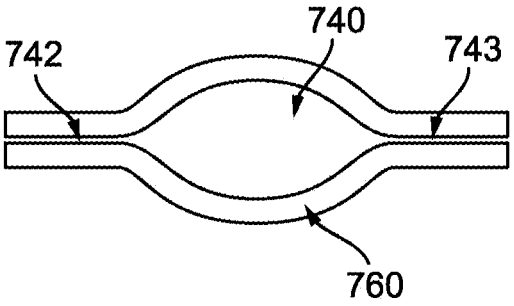

FIGS. 7A-7D illustrate a method of manufacturing an embodiment of an insert. As shown in FIG. 7A, a jacket 760 of the insert can be formed out of one or more materials. In some embodiments, the jacket 760 can be made out of a square or rectangular piece of material that can be folded in half to allow opposing sides of the piece of material to be sealed together, thereby forming a cylindrical passageway 740 and a first sealed side 742 (see also FIG. 7C). In some embodiments, the jacket 760 can be made from two pieces of material that are substantially aligned and sealed (e.g., heat sealed) together along opposing sides to form the first sealed side 742 and a second sealed side 743, such as shown in FIG. 7D. Furthermore, one or both ends of the jacket 760 can be sealed, such as after forming the first sealed side 742, as shown in FIG. 7B.

For example, a first end of the jacket can be sealed thereby forming a first sealed end 744. After forming the first sealed end 744, a vaporizable material can be deposited in the jacket component, such as through the unsealed second end and into the cylindrical passageway 740. The vaporizable material may be a non-liquid vaporizable material including, for example, a plant material (e.g., tobacco leaves), a plant material based product (e.g., reconstituted tobacco), and/or the like. In some embodiments, the vaporizable material may include a sponge that is at least partly saturated with a liquid vaporizable material. After depositing a desired amount of material (e.g., tobacco) in the jacket component, the second end can be sealed to form a second sealed end 746. Such sealing of the second end can form a sealed or substantially sealed inner chamber within the jacket 760, thereby containing the deposited material in the inner chamber. Although the method of forming and filling an embodiment of a jacket is described as including a single jacket component, a similar method can be used for forming and filling an embodiment of a jacket including more than one jacket component without departing from the scope of this disclosure.

Figure 8A:
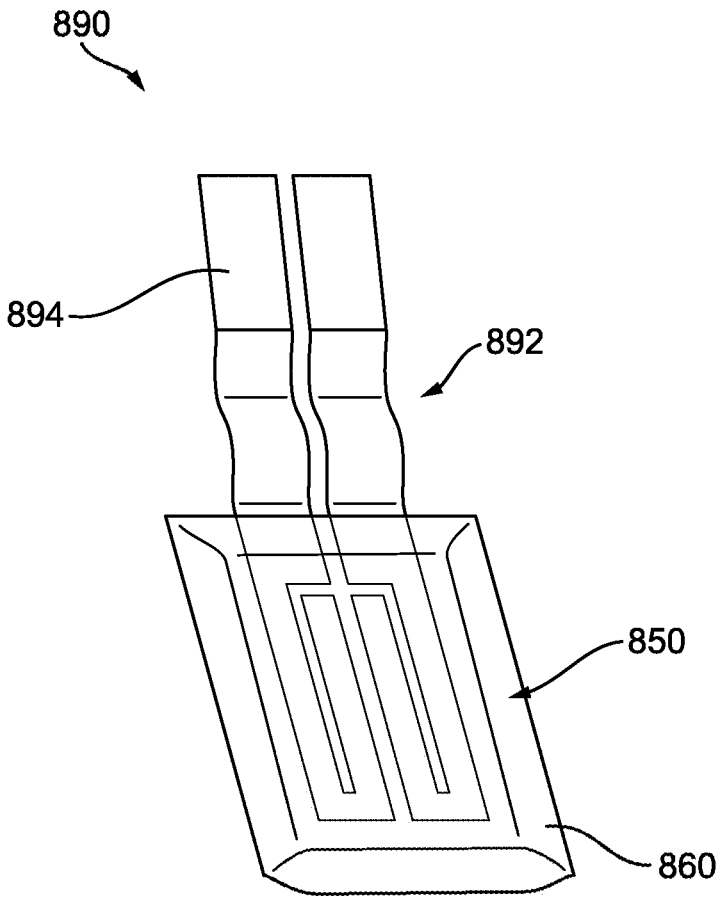
FIG. 8A illustrates a top perspective end view of an embodiment of a combined insert and heater configuration.
Figure 8B:
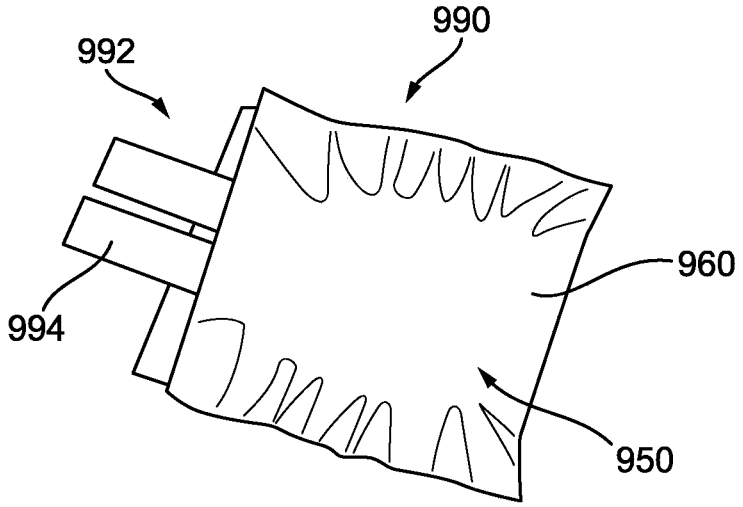
FIG. 8B illustrates a top view of another embodiment of a combined insert and heater configuration.

FIGS. 8A and 8B illustrate embodiments of an insert heater 890, which includes an insert 850 (such as any of the inserts described herein) and a heater component 892 (such as any heater component described herein). For example, FIG. 8A illustrates an embodiment of an insert heater 890 including an insert 850 having a jacket 860 made out of at least one of an insulation and protection layer (e.g., Kapton material) and a thermally conductive material (e.g., metallic material). The jacket 860 can include an inner chamber filled or substantially filled with a vaporizable material. The vaporizable material may be a non-liquid vaporizable material including, for example, a plant material (e.g., tobacco leaves), a plant material based product (e.g., reconstituted tobacco), and/or the like. In some embodiments, the vaporizable material may include a sponge that is at least partly saturated with a liquid vaporizable material. Additionally, the insert heater 890 can include a heater component 892 that can include at least one thermally conductive element. For example, the heater component 892 can be made out of a flat plate of electrically conductive material having a variety of configurations and a resistance that causes the heater component 892 to increase in temperature as a current is applied along the electrically conductive material. The heater component 892 can include at least one conductive extension 894 that can couple to a power source (e.g., couple to power source 112 via receptacle contacts 125) and allow a current to travel along the heater component 892. As shown in FIG. 8A, the heater component 892 can at least partially extend between the insulation and protection layer and the thermally conducive material comprising the jacket 860. As the heater component 892 increases in temperature, the thermally conductive material can increase in temperature thereby heating the vaporizable material contained in the inner chamber 862.

FIG. 8B illustrates another embodiment of an insert heater 990 including an insert 950 having a jacket 960 made out of a biodegradable material (e.g., tobacco material). The jacket 960 can include an inner chamber filled or substantially filled with a vaporizable material. The vaporizable material may be a non-liquid vaporizable material including, for example, a plant material (e.g., tobacco leaves), a plant material based product (e.g., reconstituted tobacco), and/or the like. In some embodiments, the vaporizable material may include a sponge that is at least partly saturated with a liquid vaporizable material. Additionally, the insert heater 990 can include a heater component 992 that can include at least one thermally conductive element. For example, the heater component 992 can be made out of a flat plate of electrically conductive material having a variety of configuration and a resistance that causes the heater component 992 to increase in temperature as a current is applied along the electrically conductive material. The heater component 992 can include at least one conductive extension 994 that can couple to a power source (e.g., couple to power source 112 via receptable contacts 125) and allow a current to travel along the heater component 992. As shown in FIG. 8B, the heater component 992 can at least partially extend within the jacket 960, such as within or along the inner chamber of the jacket 960. As such, the heater component 992 can be in direct contact with the vaporizable material contained within the jacket 960 and as the heater component 992 increases in temperature, the vaporizable material can increase in temperature.

Figure 9A:
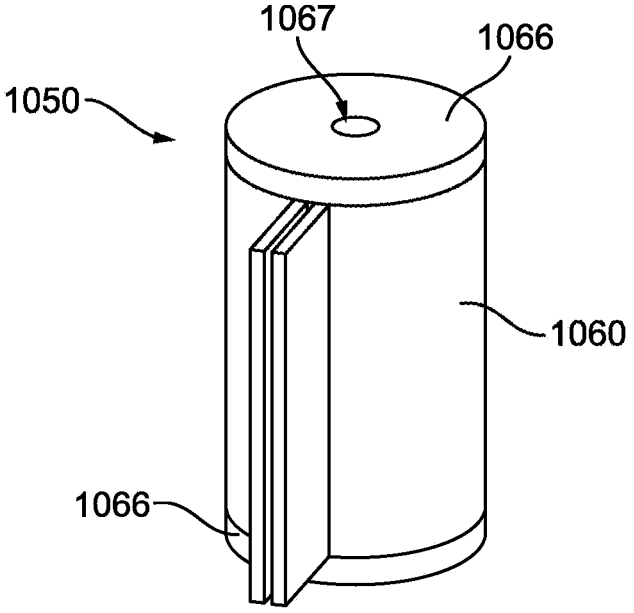
FIGS. 9A-9G illustrate another embodiment of an insert and a method of manufacturing the insert.
Figure 9B:
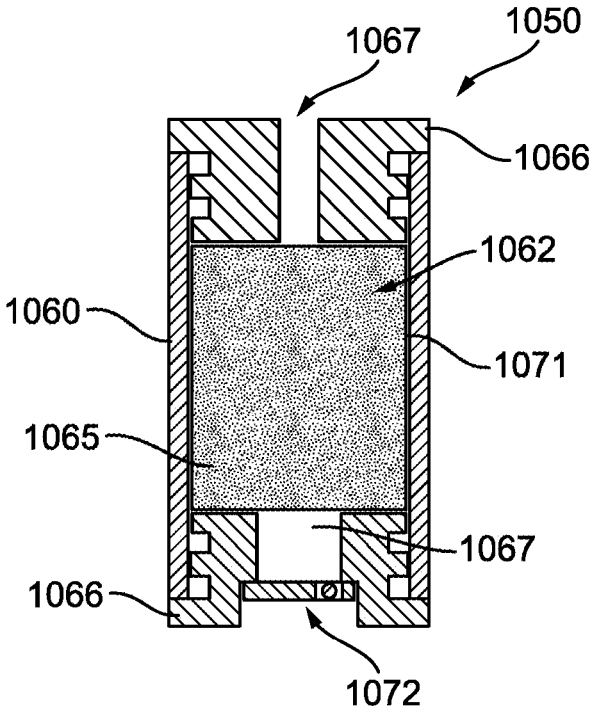

FIGS. 9A-9G illustrate another embodiment of an insert 1050 and a method of manufacturing the insert 1050. As shown in FIG. 9A, the insert 1050 can include a jacket 1060 and first and second end caps 1066 coupled to opposing ends of the jacket 1060. An inner chamber 1062 can be positioned between the first and second end caps 1066 and within the jacket 1060. The inner chamber 1062 can be filled or substantially filled with a vaporizable material 1065. The vaporizable material 1065 may be a non-liquid vaporizable material including, for example, a plant material (e.g., tobacco leaves), a plant material based product (e.g., reconstituted tobacco), and/or the like. In some embodiments, the vaporizable material may include a sponge that is at least partly saturated with a liquid vaporizable material. A thermally conductive material 1071 can line at least a part of the inner chamber 1062 such that heating of the thermally conductive material 1071 can heat the vaporizable material 1065, such as to form an inhalable aerosol. As shown in FIG. 9B, at least one of the first and second end caps 1066 can include a through hole 1067 for allowing airflow, including aerosol, to pass therethrough. In some embodiments, at least one through hole 1067 can include a pierceable material 1072 that can provide an airtight seal within the inner chamber 1062 until the pierceable material 1072 is broken or pierced. For example, the pierceable material 1072 can be broken or pierced before or during insertion of the insert 1050 into a vaporizer device 100.

Figure 9C:
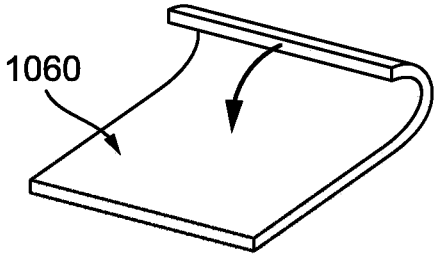
Figure 9D:
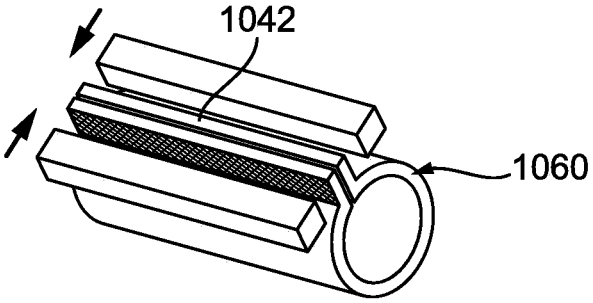
Figure 9E:
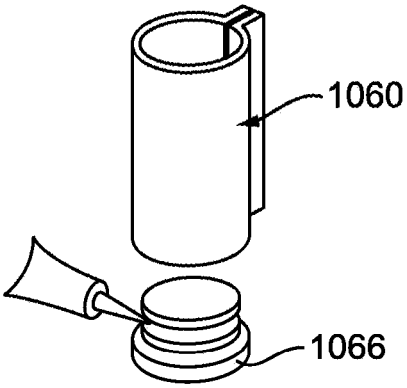
Figure 9F:
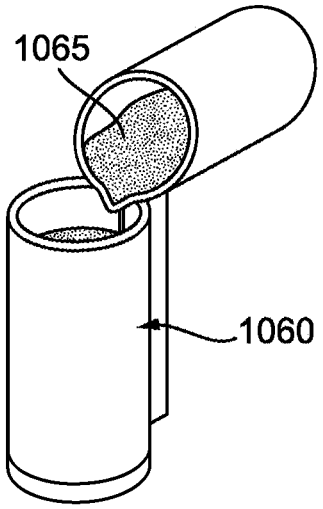
Figure 9G:
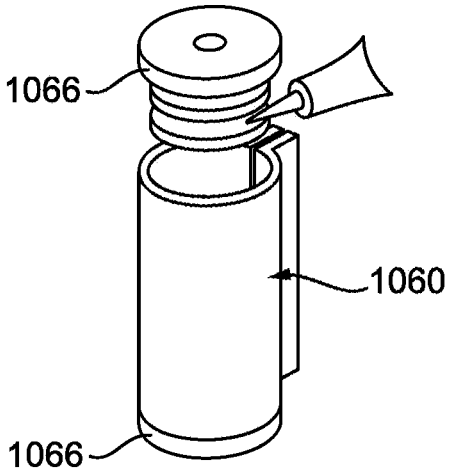
Figure 9H:
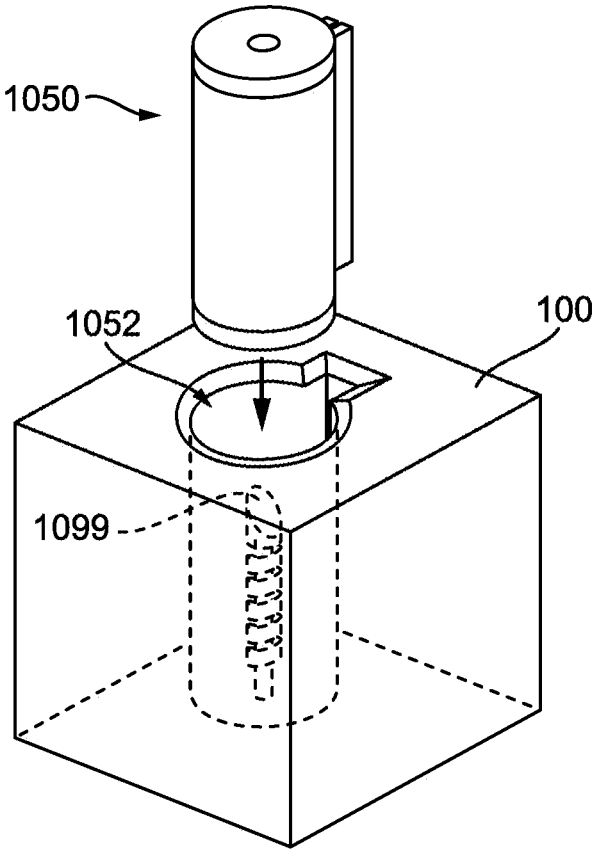
FIGS. 9H and 9I illustrate an embodiment of a vaporizer device having a piercing member that can be configured to pierce an insert, such as the insert described with respect to FIGS. 9A-9G.
Figure 9I:
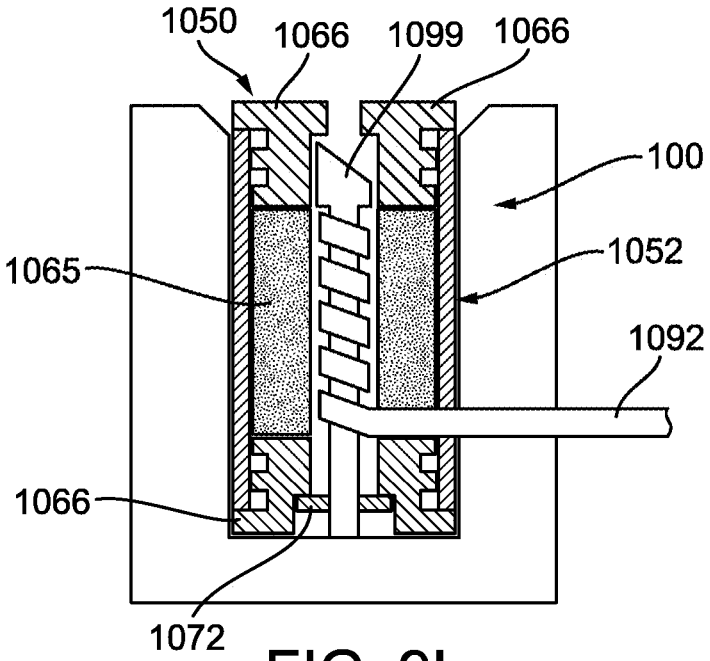

FIGS. 9H and 9I illustrate an embodiment of a vaporizer device 100 having a piercing member 1099 that can be configured to pierce an insert, such as the insert 1050 described above with respect to FIGS. 9A-9G. For example, the piercing member 1099 can extend along a center axis of a chamber or compartment 1052 configured to receive the insert 1050. As such, the piercing member 1099 can pierce the pierceable material 1072 of the insert 1050 as the insert 1050 is inserted in the compartment 1052. The piercing member 1099 can include a heater component 1092 that can include a thermally and/or electrically conductive material. The heater component 1092 can be configured to heat the vaporizable material 1065 in the insert 1050, which can be in direct contact with the heater component 1092, as shown in FIG. 9I.

As shown in FIGS. 9C and 9D, the jacket 1060 can be formed by forming a first sealed side 1042 of a jacket component (e.g., a piece of material that is used to form the jacket 1060), such as described above with respect to FIG. 7A. Additionally, after the first sealed side 1042 has been formed, a first end cap 1066 can be securely coupled to a first end of the jacket 1060, as shown in FIG. 9E. A vaporizable material 1065 can then be added to the inner chamber via a second end of the jacket 1060, after which the second cap 1066 can be securely coupled to the second end. Such securing of the first and second end caps 1066 can be achieved by any number of securing features and methods, including using an adhesive.

Figure 10A:
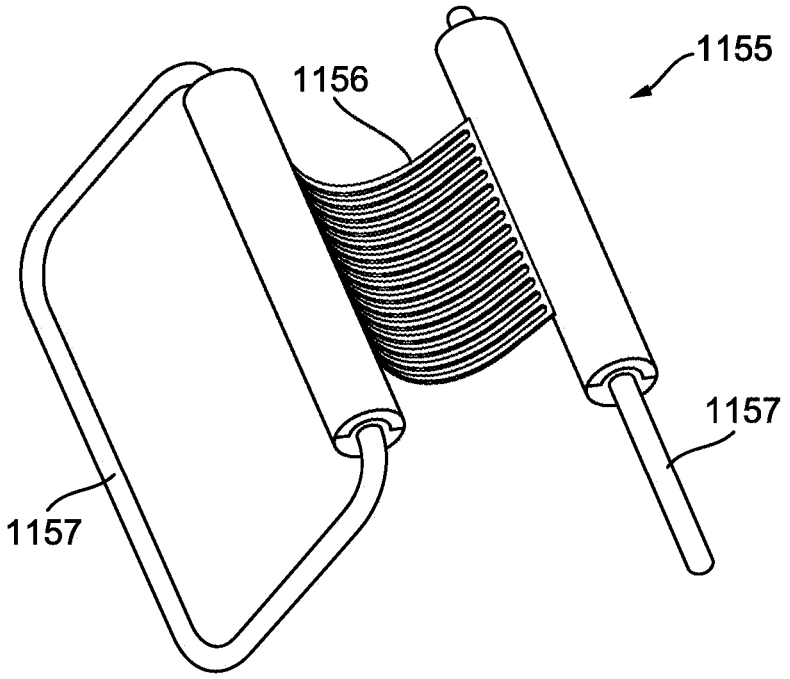
FIG. 10A illustrates a top perspective view of an embodiment of an insert heater configured to heat an insert.
Figure 10B:
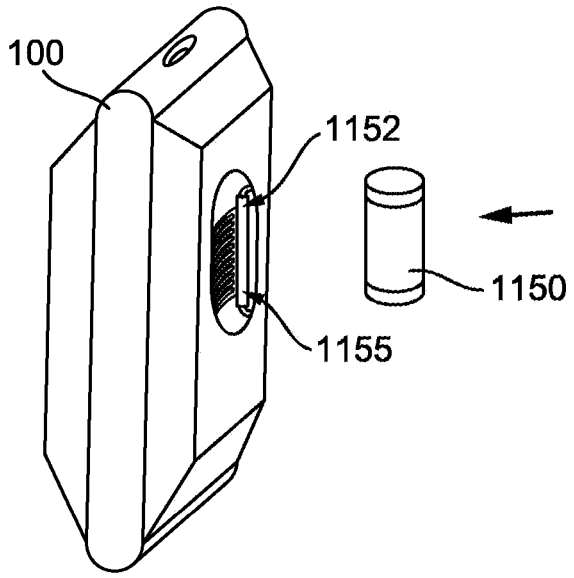
FIG. 10B illustrates insertion of the insert into the insert heater of FIG. 10A integrated in a vaporizer device.
Figure 10C:
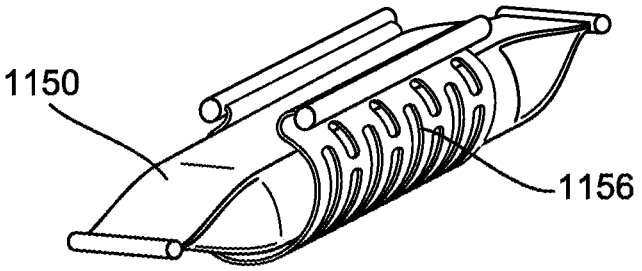
FIG. 10C illustrates a perspective end view of the insert heater of FIG. 10A with an insert positioned within a cradle of the insert heater.
Figure 10D:
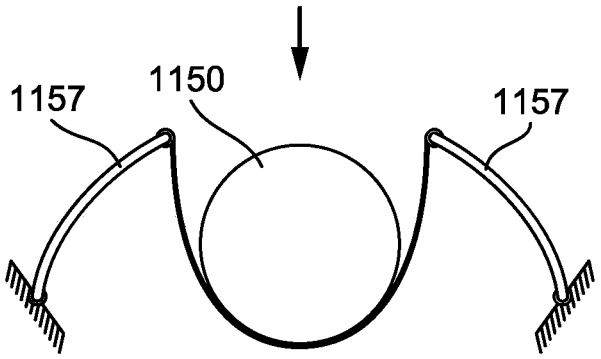
FIG. 10D illustrates an end view of the insert heater of FIG. 10A in an open configuration.
Figure 10E:
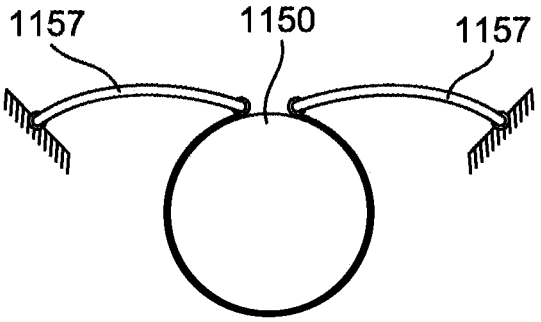
FIG. 10E illustrates an end view of the insert heater of FIG. 10A in a closed configuration.

FIGS. 10A-10E illustrate an embodiment of a heating element including an insert heater 1155 that can be included in a vaporizer device 100. FIG. 10A illustrates the insert heater 1155, which can include a flexible heating element 1156 secured to and extending between first and second pivoting supports 1157. As shown in FIG. 10C-10E, the flexible heating element 1156 can form an open configuration (FIG. 10D) when the first and second pivoting supports 1157 are in a first position, thereby allowing the insert 1150 to be placed in contact with the flexible heating element 1156. When the first and second pivoting supports 1157 form a closed configuration, the flexible heating element 1156 can wrap around or substantially around the insert 1150, as shown in FIG. 10E, which can result in efficient and effective heat transfer between the flexible heating element 1155 and the insert 1150. Such efficient and effective heat transfer can allow for desired heating of the vaporizable material of the insert 1150, such as into an inhalable aerosol. The vaporizable material may be a non-liquid vaporizable material including, for example, a plant material (e.g., tobacco leaves), a plant material based product (e.g., reconstituted tobacco), and/or the like. In some embodiments, the vaporizable material may include a sponge that is at least partly saturated with a liquid vaporizable material. In some embodiments, the vaporizable material may include a gel-based consumable.

As shown in FIG. 10B, the flexible heating element 1156 can be positioned within a chamber or compartment 1152 of the vaporizer device 100 and the compartment 1152 can be configured for receiving the insert 1150. When the insert 1150 is not inserted in the compartment 1152, the insert heater 1155 can be in the open configuration. When the insert 1150 is inserted in the compartment 1152, the insert 1150 can push against the flexible heating element 1156, thereby causing the first and second pivoting supports 1157 to pivot and cause the insert heater 1155 to form the closed configuration. Once in the closed configuration, the insert heater 1155 can be activated for heating the insert 1150.

Figure 11:
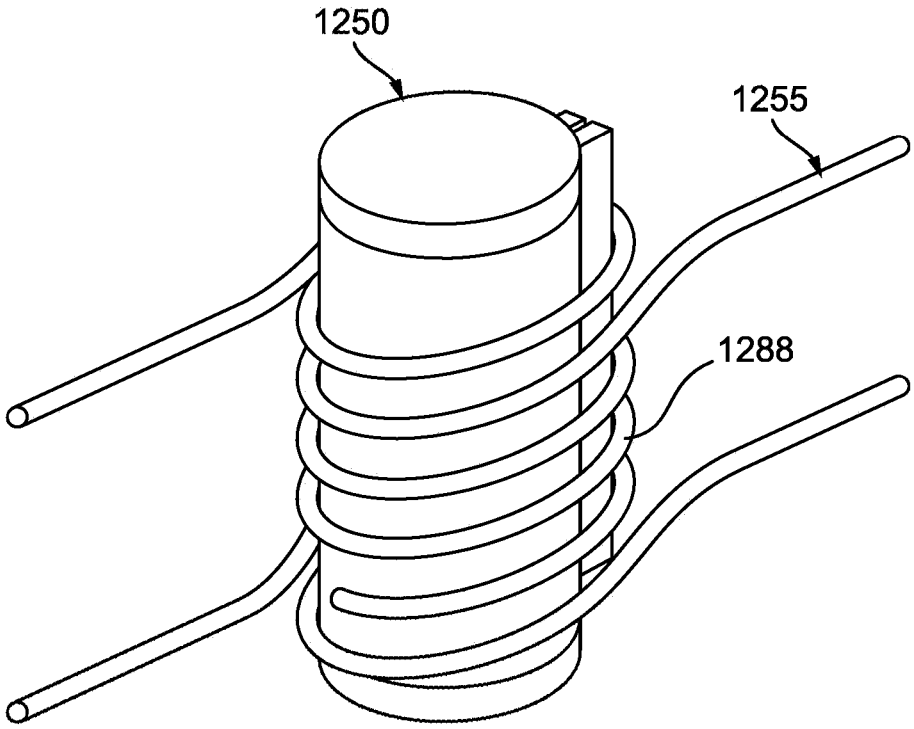
FIG. 11 illustrates another embodiment of an insert heater that can be included in a vaporizer device.

FIG. 11 illustrates another embodiment of an insert heater 1255 that can be included in a vaporizer device 100. As shown in FIG. 11, the insert heater 1255 can include one or more coiled springs 1288 made out of a thermally and/or electrically conductive material that can increase in temperature for heating an adjacent insert. The coil springs 1288 can be shaped to allow the insert 1250 to be releasably inserted within the coiled springs 1288 such that the coiled springs 1288 extend around the circumference and along a length of the insert 1250 when the insert 1250 is coupled to the insert heater 1255. This can allow the insert heater 1255 to efficiently and effectively heat the vaporizable material contained within the insert 1250, such as of forming an inhalable aerosol.

In some embodiments, the insert may be configured to heat a liquid vaporizable material in addition to heating the non-liquid vaporizable material to allow formation of an inhalable aerosol including a vapor mixture of both the non-liquid vaporizable material and the liquid vaporizable material for inhalation by a user. The vaporizable material may be a non-liquid vaporizable material including, for example, a plant material (e.g., tobacco leaves), a plant material based product (e.g., reconstituted tobacco), and/or the like. Embodiments of an insert including components that allow for such formation of an inhalable aerosol including vapor of both non-liquid and liquid vaporizable material are described herein.

Figure 12:
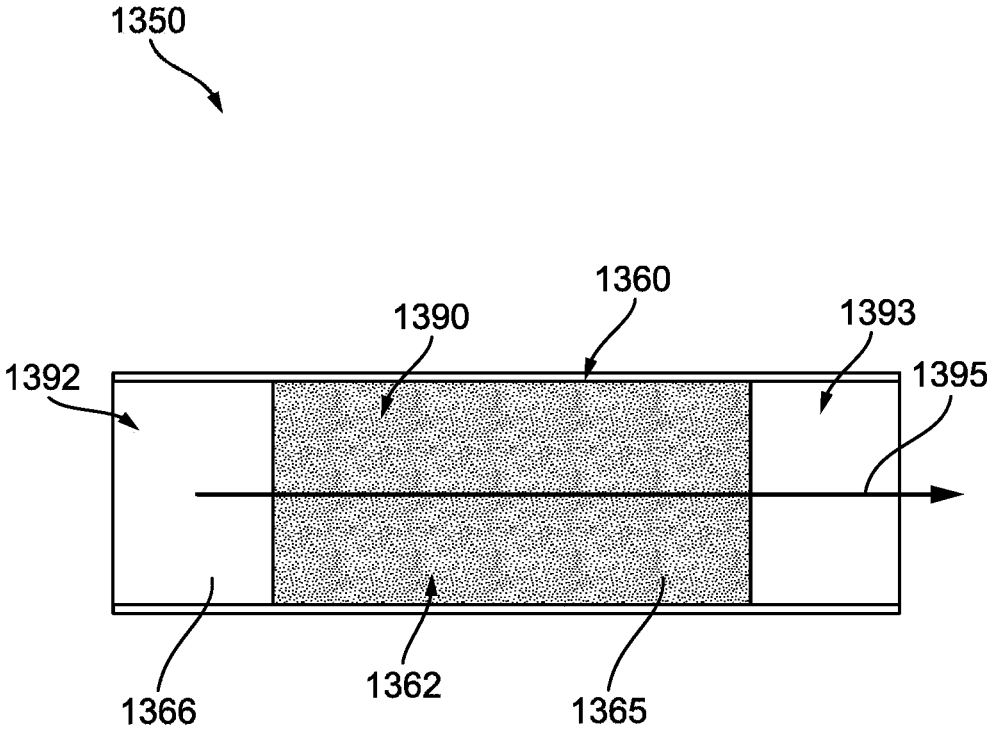
FIG. 12 illustrates another embodiment of an insert including a filter containing a liquid vaporizable material.

FIG. 12 illustrates another embodiment of the insert 1350 including a jacket 1360 that forms an inner chamber 1362 having a first region 1390 and a second region 1392. The jacket 1360 can be cylindrical or any of a variety of shapes. For example, the first region 1390 can be configured to contain a non-liquid vaporizable material 1365 and the second region 1392 can be configured to include a filter 1366. The non-liquid vaporizable material 1365 can include, for example, a plant material (e.g., tobacco leaves), a plant material based product (e.g., reconstituted tobacco), and/or the like In some embodiments, the filter 1366 can be made out of cotton and/or at least partly saturated with a liquid vaporizable material (e.g., Propylene Glycol (PG) and/or Vegetable Glycerin (VG) based liquid).

As shown in FIG. 12, the second region 1392 can be positioned upstream the airflow pathway 1395 relative to the first region 1390. As such, air passing through the insert 1350 may draw liquid vaporizable material vapor into the airflow prior to passing through the second region 1392 containing the non-liquid vaporizable material thereby absorbing/infusing the inhalable aerosol with both flavor and nicotine content from the non-liquid vaporizable material. Other configurations are within the scope of this disclosure, including positioning the non-liquid vaporizable material upstream of the filter containing a liquid vaporizable material.

In some embodiments, a heating element may extend around a circumference and/or along a length of the jacket 1360 of the insert 1350. Such a configuration, for example, can allow the heating element to efficiently and effectively heat the liquid vaporizable material (contained in the filter 1366) in the second region 1392 and the non-liquid vaporizable material in the first region 1390. In some embodiments, the filter 1366 may be in direct contact with the heating element 1355.

For example, the heating element 1355 can heat the liquid vaporizable material in the filter 1366 thereby causing the liquid vaporizable material to be vaporized and released into the airflow pathway 1395. The heating element 1355 can also heat the non-liquid vaporizable material in the first region thereby causing the non-liquid vaporizable material to be vaporized and released into the airflow pathway 1395. The vapor formed form the non-liquid vaporizable material can be combined with vapor produced from the liquid vaporizable material along the airflow pathway 1395 and drawn out of the insert 1350 for inhalation by a user.

Such insert embodiments including a first and second region including non-liquid vaporizable material and liquid vaporizable material, respectively, may provide various benefits such as reducing manufacturing costs (e.g., by only requiring one heater) and improving performance and efficiency of the vaporizer device.

In some embodiments, the heating element 1355 may be controlled (e.g., by a processor) or configured to heat the first region 1390 at a different temperature than the second region 1392. Various temperatures and temperature differences provided by the heating element 1355 along the insert 1350 are within the scope of this disclosure.

In some embodiments, the airflow pathway 1395 may extend through a center or along a longitudinal axis of the insert 1350.

In another embodiment, the second region 1392 of the insert 1350 may include a reservoir configured to contain a liquid vaporizable material. An airflow pathway may pass through or adjacent the first and/or second regions. A first inhalable vapor created from heating and/or vaporizing the liquid vaporizable material in the reservoir may pass through the non-liquid vaporizable material contained in the first region 1390 thereby infusing the first inhalable vapor with nicotine and flavor from the non-liquid vaporizable material (forming a second inhalable vapor including the infused first inhalable vapor).

As shown in FIG. 12, in some embodiments the insert 1350 may include a cooling filter 1393 (e.g., cotton filter) positioned downstream the airflow pathway 1395 relative to the first region 1390 and second region 1392. The cooling filter 1393 can be configured to cool the inhalable aerosol prior to inhalation by the user.

Terminology

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A system for generating an inhalable aerosol, the system comprising:
- an insert, comprising:
  - a jacket defining an inner chamber;
  - a vaporizable material contained in the inner chamber; and
- a vaporizer device comprising:
  - a compartment configured to receive the insert; and
  - a heating element configured to heat the insert positioned in the compartment to generate the inhalable aerosol, wherein the heating element comprises either:
    - an insert capturing and heating mechanism including a first foil heater coupled via a spring mechanism to a second foil heater, the spring mechanism configured to allow the first foil heater and second foil heater to transition between an open configuration and a closed configuration, the open configuration allowing the insert to be positioned between the first foil heater and second foil heater, and the closed configuration causing the first foil heater and second foil heater to at least partly conform to opposing sides of the insert for heating the insert to generate the inhalable aerosol, or
    - an insert heater including a flexible heating element extending between pivoting supports, the pivoting supports allowing the insert heater to transition between an open configuration and a closed configuration, the open configuration allowing the flexible heating element to receive the insert, and the closed configuration allowing the flexible heating element to wrap around at least a part of the insert for heating the insert to generate the inhalable aerosol.

2. The system of claim 1, wherein the jacket is made out of the vaporizable material.

3. The system of claim 1, wherein the jacket includes a through hole configured to allow air to pass into and/or out of the insert.

4. The system of claim 1, wherein the jacket is configured to prevent passage of air through the insert until heated or degenerated due to heating.

5. The system of claim 1, wherein the heating element is coupled to a piercing member extending into the compartment of the vaporizer device, the piercing member configured to pierce the insert as the insert is inserted into the compartment thereby positioning the heating element within the inner chamber of the insert.

6. The system of claim 1, wherein the heating element comprises a coiled spring configured to extend around a circumference of the insert.

7. The system of claim 1, wherein the vaporizable material comprises at least one of a plant material, a plant material based product, a tobacco leaf, and a reconstituted tobacco.

8. The system of claim 1, wherein the vaporizable material comprises a gel material.

9. The system of claim 1, wherein the vaporizable material comprises a sponge at least partly saturated with a liquid vaporizable material.

10. The system of claim 1, wherein a portion of the jacket is made out of a thermally conductive material.

11. The system of claim 1, wherein the jacket includes a first through hole at a first end of the jacket and a second through hole at a second end of the jacket, wherein the first end is opposite the second end.

12. An insert for use with a vaporizer device, the insert comprising:

a jacket forming an inner chamber, the jacket being formed of a first vaporizable material, wherein the jacket is configured to prevent air from entering the inner chamber until heated or degenerated due to heating;

a second vaporizable material contained in the inner chamber; and a heating element in contact with one or both of the first vaporizable material and the second vaporizable material, the heating element being configured to heat the first vaporizable material and the second vaporizable material to form an inhalable aerosol.

13. The insert of claim 12, wherein each of the first vaporizable material and the second vaporizable material comprises a non-liquid vaporizable material.

14. The insert of claim 12, wherein each of the first vaporizable material and the second vaporizable material comprises a sponge at least partly saturated with a liquid vaporizable material.

15. The insert of claim 12, wherein the heating element includes a flat plate of electrically conductive material, at least a part of the heating element positioned within the inner chamber of the insert.

16. The insert of claim 12, wherein each of the first vaporizable material and the second vaporizable material comprises a loose-leaf tobacco.

17. The insert of claim 12, further comprising a first end cap and a second end cap coupled to opposing ends of the jacket.

18. The insert of claim 12, wherein each of the first vaporizable material and the second vaporizable material comprise a plant material based product.

* * * * *